United States Patent [19]

Schnatzmeyer

[11] Patent Number: 4,828,027

[45] Date of Patent: May 9, 1989

[54] APPARATUS FOR MONITORING A PARAMETER IN A WELL

[75] Inventor: Mark A. Schnatzmeyer, Lewisville, Tex.

[73] Assignee: Otis Engineering Corporation, Dallas, Tex.

[21] Appl. No.: 177,931

[22] Filed: Apr. 4, 1988

Related U.S. Application Data

[60] Division of Ser. No. 889,225, Jul. 24, 1986, Pat. No. 4,757,859, which is a continuation-in-part of Ser. No. 653,585, Sep. 24, 1984, Pat. No. 4,624,309.

[30] Foreign Application Priority Data

Aug. 19, 1985 [AU] Australia ..... 46299/85
Aug. 27, 1985 [GB] United Kingdom ..... 8521339

[51] Int. Cl.[4] ..... E21B 23/00; E21B 23/03

[52] U.S. Cl. ..... 166/117.5; 166/123; 166/181

[58] Field of Search ..... 166/65.1, 66, 117.5, 166/117.6, 250, 123, 124, 125, 181, 380, 382; 439/271, 426; 73/151

[56] References Cited

U.S. PATENT DOCUMENTS

| | | | |
|---|---|---|---|
| Re. 29,870 | 2/1988 | Runbaugh | 166/117.5 |
| 2,828,822 | 4/1958 | Greer | 166/178 |
| 2,851,110 | 9/1958 | Greer | 166/178 |
| 2,962,097 | 11/1960 | Dollison | 166/136 |
| 3,353,608 | 11/1967 | Beese et al. | 166/117.5 |
| 3,827,490 | 8/1974 | Moore, Jr. et al. | 166/117.5 |
| 3,837,398 | 9/1974 | Yonker | 166/117.5 |
| 3,876,001 | 4/1975 | Goode | 166/117.5 |
| 4,031,954 | 6/1977 | Herbert et al. | 166/117.5 |
| 4,035,011 | 7/1977 | Garda et al. | 294/86.15 |
| 4,051,895 | 10/1977 | Embree | 166/117.5 |
| 4,103,740 | 8/1978 | Yonker | 166/117.5 |
| 4,105,279 | 8/1978 | Glotin et al. | 339/117 R |
| 4,224,986 | 9/1980 | Rothberg | 166/117.5 |
| 4,294,313 | 10/1981 | Schwegman | 166/117.5 |
| 4,325,431 | 4/1982 | Akkerman | 166/117.5 |
| 4,333,527 | 6/1982 | Higgins et al. | 166/117.5 |
| 4,368,780 | 1/1986 | Merritt | 166/117.5 |
| 4,440,222 | 4/1984 | Pullin | 166/117.5 |
| 4,456,330 | 11/1983 | Merritt et al. | 166/117.5 |
| 4,508,165 | 4/1985 | Foust | 166/117.5 |
| 4,667,736 | 5/1987 | Rumbaugh et al. | 166/65.1 |

*Primary Examiner*—William P. Neuder
*Attorney, Agent, or Firm*—Albert W. Carroll

[57] ABSTRACT

Apparatus including a side pocket mandrel for inclusion in a well tubing string for removably receiving an instrument in its offset receptacle bore for monitoring at least one parameter such as pressure, temperature or the like, at a downhole location, there being an electrical conductor wire extending from equipment at the surface downward to the side pocket mandrel and a plug in the lower end of the receptacle for electrically connecting the instrument in the receptacle with the conductor wire extending from the surface so that electrical energy may be transmitted downhole to power the instrument, that the instrument may generate electrical signals representing data sensed in the well and transmit them to the surface for processing and immediate display, printout, or storage. Suitable kickover tools and running tools are also disclosed. In addition, method and means for running and installing a well device in a receptacle in a well are also disclosed wherein louvered friction members are utilized to releasably connect the well device to a running tool, by which it is lowered into the well, and also for retaining the well device in said receptacle.

4 Claims, 13 Drawing Sheets

APPARATUS FOR MONITORING A PARAMETER IN A WELL

This is a division of application Ser. No. 06/889,825 filed July 24, 1986 now U.S. Pat. No. 4,757,859 entitled "APPARATUS FOR MONITORING A PARAMETER IN A WELL", which is a conintuation-in-part of application Ser. No. 06/653,585 filed Sept. 24, 1984, now U.S. Pat. No. 4,624,309.

BACKGROUND OF THE INVENTION

1. Field of the Invention

This invention relates to well tools and more particularly to apparatus for monitoring one or more parameters (such as pressure, temperature, or the like) in a well.

2. Related Art and Information

It has been common practice for many years to record downhole pressures, temperatures, and other parameters in wells through use of instruments lowered from the surface on wire line, electric cable, or similar means. The instruments were powered by clockworks, or by electrical energy either supplied by a battery carried in them or transmitted to them from the surface. Data gathered in this manner were recorded on a chart, stored in a memory bank after being processed by a microprocessor, or in cases where the instrument was powered by electricity transmitted to it from the surface, data sensed by the instrument were generally converted to electrical signals which were transmitted via the electrical cable to suitable equipment at the surface which processed the signals and displayed these data in real time and/or stored the resultant data for subsequent printout.

It is known to install instruments in wells for recording or gathering data over a period of several hours or several days during which time other tools may be lowered into the well, the instrument being later retrieved with a retrieval tool. It is known to use a special side pocket mandrel in which to install instruments for such purposes. The side pocket mandrel is connectable in the well tubing string to form a part thereof, has a main bore therethrough aligned with the tubing bore, has a receptacle bore laterally offset from the main bore and extending alongside thereof, the receptacle bore having an upstanding electrical contact or prong in its lower end connected through an insulated plug to an insulated conductor (wire) extending from the plug to suitable equipment at the surface. The instrument in this case is lowered into the well on a wire line and kickover tool and installed in the receptacle bore after which the wire line and kickover tool are retrieved from the well. When the instrument is installed in the side pocket mandrel, an electrical socket in its lower end telescopes down over the upstanding electrical contact in the receptacle bore to establish electrical contact so that the instrument may receive electrical energy transmitted thereto from the surface and so that the instrument may send suitable electrical signals to the surface for processing, display, printout, and/or storage in a memory bank.

Examples of side pocket mandrels, downhole electrical connectors, kickover tools, and running tools are found in the prior patents listed below (one copy each of the most pertinent ones being enclosed with this application).

| Patents of The United States | | | | |
|---|---|---|---|---|
| Re.24,403 | 3,054,456 | 3,713,483 | 3,867,983 | 4,106,563 |
| Re.25,292 | 3,059,210 | 3,727,683 | 3,874,445 | 4,106,564 |
| Re.28,588 | 3,059,700 | 3,727,684 | 3,876,001 | 4,135,576 |
| Re.29,870 | 3,105,509 | 3,729,699 | 3,889,748 | 4,146,091 |
| 2,282,822 | 3,268,006 | 3,732,928 | 3,891,032 | 4,169,505 |
| 2,664,162 | 3,277,838 | 3,736,548 | 3,899,025 | 4,197,909 |
| 2,679,903 | 3,282,348 | 3,741,299 | 3,939,705 | 4,201,265 |
| 2,679,904 | 3,311,509 | 3,741,303 | 3,958,633 | 4,224,986 |
| 2,824,525 | 3,353,607 | 3,752,231 | 3,965,979 | 4,239,082 |
| 2,828,698 | 3,353,608 | 3,753,206 | 3,994,339 | 4,271,902 |
| 2,851,110 | 3,378,811 | 3,788,397 | 4,002,203 | 4,294,313 |
| 2,914,078 | 3,398,392 | 3,796,259 | 4,030,543 | 4,325,431 |
| 2,923,357 | 3,439,626 | 3,799,259 | 4,031,954 | 4,333,527 |
| 2,942,671 | 3,491,326 | 3,802,503 | 4,033,409 | 4,368,780 |
| 2,948,341 | 3,561,528 | 3,807,428 | 4,034,806 | 4,375,237 |
| 2,962,097 | 3,581,818 | 3,807,498 | 4,035,011 | 4,416,330 |
| 2,964,110 | 3,603,393 | 3,807,499 | 4,039,026 | 4,440,222 |
| 2,994,335 | 3,610,336 | 3,827,489 | 4,051,895 | 4,442,893 |
| 3,014,533 | 3,627,042 | 3,827,490 | 4,066,128 | 4,452,305 |
| 3,022,829 | 3,641,479 | 3,828,853 | 4,103,740 | 4,589,717 |
| 3,040,814 | 3,666,012 | 3,837,398 | 4,105,279 | |
| Patents of Canada | | | | |
| | 991539 | | 1001065 | |

U.S. Pat. No. Re. 29,870 which issued to Howard H. Moore, Jr., et al. on Dec. 26, 1978 and the original thereof, U.S. Pat. No. 3,827,490 which issued to Howard H. Moore, Jr., et al. on Aug. 6, 1974, disclose an orienting type side pocket mandrel which is considered typical. It has the usual main bore, an offset receptacle bore alongside thereof, a belly above the receptacle bore providing space for operation of a kickover tool, and an orienting sleeve above the belly for orienting a kickover tool with respect to the receptacle bore.

U.S. Pat. No. 3,827,490 which issued to Harold E. McGowen, Jr. on Aug. 6, 1974, discloses an orienting type side pocket mandrel which has an orienting sleeve below the receptacle for orienting a kickover tool and a trip shoulder above the belly for actuating such kickover tool.

U.S. Pat. No. 4,294,313 which issued to Harry E. Schwegman on Oct. 13, 1981, discloses an orienting type side pocket mandrel having much the same characteristics as the mandrel of U.S. Pat. No. 3,827,490 but having a 360-degree trip shoulder above the belly for actuating a pumpdown type kickover tool.

U.S. Pat. No. 4,333,527 which issued to Robert S. Higgins, et al. on June 8, 1982, discloses a side pocket mandrel of the orienting type constructed without longitudinal structural welds and made sturdy to withstand high differential pressures in either burst or collapse, the main body portion being formed essentially from a solid block of steel.

U.S. Pat. No. 4,416,330 which issued to David T. Merritt, et al., on Nov. 22, 1983, discloses a side pocket mandrel structured very much like that of U.S. Pat. No. 4,333,527, but wherein the upper body section of the mandrel has a main bore and a longitudinal keyway-like channel formed in the wall of the main bore, this channel being aligned with the receptacle bore and providing space thereabove for the operation of a kickover tool.

U.S. Pat. No. 4,440,222 which issued to William H. Pullin on Apr. 3, 1984, discloses orienting type side pocket mandrels having improved orienting sleeves.

U.S. Pat. No. 3,939,705 which issued to Bernard J. P. Glotin, et al. on Feb. 24, 1976, and U.S. Pat. No. 4,105,279 which issued to Bernard J. P. Glotin, et al. on Aug. 8, 1978, the latter patent being a division of the former patent, disclose side pocket mandrels of the non-orienting type each having a main bore, an offset receptacle bore, a belly above the receptacle bore providing space for operation of a kickover tool, and an upstanding electrical contact in the offset receptacle bore engageable by a mating electrical socket on a monitoring instrument instaled in the receptacle bore, the electrical contact in the receptacle bore being connected via an electrical conductor extending to the surface. These patents disclose in detail the mating parts of the plug-in connector (that portion carried on the instrument and that portion carried on the side pocket mandrel).

U.S. Pat. No. 4,589,717 issued to Alain P. Pottier, et al. on May 20, 1986 and discloses an electrical connector for downhole use in a well. This connector comprises mating male and female portions. The female portion contains a liquid dielectric and a spring-biased shuttle or plug for closing the open upper end to prevent escape thereof. At mating, the plug is depressed to allow mating of the parts and the liquid dielectric is displaced, increasing its pressure and moving a spring-biased piston. This dielectric being slightly pressured by the movement of the plug and being in contact with the exterior of the contacts, urges the same inwardly to assure better electrical contact between the male and female parts.

Additional prior art plug-in connections for subsurface use are disclosed in U.S. Pat. Nos. 3,059,210; 3,378,811; 3,398,392; 3,491,326; 3,641,479; 3,729,699; 3,736,548; and 3,753,206.

U.S. Pat. No. 3,958,633 which issued to James A. Britch, et al. on May 25, 1976, discloses a side pocket mandrel having a lateral port in its offset receptacle bore connected to the lower end of a hydraulic control line extending from the surface.

U.S. Pat. No. 4,224,986, which issued to Robert H. Rothberg on Sept. 30, 1980, discloses a side pocket device having a pair of hydraulic control lines connected to a pair of lateral ports in its offset receptacle bore.

U.S. Pat. No. 4,325,431, which issued to Neil H. Akkerman on Apr. 20, 1982, discloses a side pocket mandrel having a lateral port in its offset receptacle bore connected to a hydraulic control line.

U.S. Pat. No. 3,353,608, which issued to Fred F. Beebe on Nov. 2, 1967, discloses an early type kickover tool which is actuated in response to its trip key engaging a downwardly facing shoulder when the kickover tool lifted in the well tubing.

U.S. Pat. No. 4,294,313, which issued to Harry E. Schwegman on Oct. 13, 1981, discloses a kickover tool of the 90-degree type wherein its pivot arm pivots from an aligned position to a misaligned position wherein it extends outward of the kickover tool at substantially 90-degrees thus making possible much shorter side pocket mandrels and applying straighter axial forces to valves and the like as they are installed and removed thereby.

U.S. Pat. No. 3,837,398, which issued to John H. Yonker on Sept. 24, 1974 is an improvement over the Schwegman kickover tool (U.S. Pat. No. 4,294,313, supra) in which the pivot arm is releasably locked in its misaligned position until withdrawn from the side pocket mandrel.

U.S. Pat. No. 4,103,740, which issued to John H. Yonker on Aug. 1, 1978 is a further improvement over the kickover tool of Schwegman (U.S. Pat. No. 4,294,313, supra) in which the orienting key is designed for more dependable operation.

U.S. Pat. No. 3,876,001, which issued to William B. Goode on Apr. 8, 1975, discloses an orienting type kickover tool which when oriented and actuated hinges intermediate its ends and swings its lower portion toward a position above the offset receptacle of a side pocket mandrel.

U.S. Pat. No. 4,051,895 which issued to Hugh D. Embree on Oct. 4, 1977, and U.S. Pat. No. 4,031,954 which issued to Gerald P. Hebert on June 28, 1977, both cover slight improvements over the kickover tool of Goode (U.S. Pat. No. 3,876,001, supra).

U.S. Pat. No. 4,368,780 which issued to David T. Merritt on Jan. 18, 1983, discloses a kickover tool which is an improvement over the kickover tool of Goode (U.S. Pat. No. 3,876,001, supra) the improvement enabling the kickover tool to be acutated by engaging a conventional orienting sleeve but without engaging the conventional tripping shoulder at the upper end of its orienting slot. A further improvement relates to a detent which helps to maintain the kickover tool in its misaligned position after it has been actuated to such position.

U.S. Pat. No. 4,442,893 which issued to Tommy C. Foust on Apr. 17, 1984, discloses an improved 90-degree type kickover tool which is very simply structured of minimal parts.

U.S. Pat. No. 2,962,097 which issued to William W. Dollison on Nov. 29, 1960, discloses (see FIG. 6) a tool having a collet for engaging a well tool and which is releasable upon shearing a pin. This type of tool can be used for certain running or pulling operations and can be arranged to shear the pin for release in response to upward or downward jarring impacts.

U.S. Pat. No. 4,035,011 which issued to Imre I. Gazda, et al. on July 12, 1977, discloses a running tool having a collet for engaging a well tool, the collet being spring biased to a position wherein the collet fingers are supported against inward movement to, thus, maintain engagement with the well tool, the collet being movable to releasing position upon application of sufficient pulling force to the running tool to overcome the spring load and move the collet to a position wherein the collet fingers are not supported and may move to releasing position.

U.S. Pat. No. 2,282,822 issued to C. B. Greer on Apr. 1, 1958 and U.S. Pat. No. 2,851,110 which issued Sept. 9, 1958 also to C. B. Greer, disclose WELL JARS for use in applying jarring impacts to well tools downhole. These jars are of the hydraulic type having a cylinder with a piston slidable therein and a piston rod extending from the piston and through the end of the cylinder. The device is filled with hydraulic medium. To avoid unwanted changes in oil pressure whenever the piston rod extends, a floating piston is provided to separate the hydraulic medium from the well fluids which enter to compensate for the displacement of the piston rod.

The present invention is an improvement over the known prior art and overcomes many of the shortcomings associated therewith and is more suitable for use with modern, more sophisticated, accurate, and very costly and delicate instruments.

SUMMARY OF THE INVENTION

The present invention is directed toward apparatus for monitoring at least one parameter at a downhole location in a well, the apparatus including a side pocket mandrel having a main bore therethrough, a receptacle bore offset from the main bore and extending alongside thereof, and a longitudinal keyway-like channel in the wall of the main bore aligned with and extending upwardly a sufficient distance from the upper end of the receptacle bore to provide space for operating a kickover tool and for protectively housing an instrument, even one of considerable length, having its lower end portion telescopingly engaged in the receptacle bore, the receptacle being provided with an electrical feedthrough member in the lower end of the receptacle bore having its internal end engageable by an electrical socket or contact on the lower end of an instrument and having its external end electrically connected via an electrical conductor (wire) to a source of electrical energy and suitable equipment at the earth's surface.

The kickover tool of this invention includes a body having a flat side with connection means at its upper end and a pivot arm pivotally mounted near the lower end thereof, an actuator having a flat side and operatively slidably connected to the body with their flat sides facing each other, the actuator having connection at its lower end with the pivot arm so that longitudinal movement of the actuator relative to the body causes the pivot arm to pivot between aligned and extended positions, the actuator carrying an orienting key near its upper end for engaging the orienting sleeve in the side pocket mandrel to cause actuation of the kickover tool to move the pivot arm from aligned to extended position.

The kickover tool is provided with a mechanism for positively locking the kickover tool in actuated position, this locking mechanism being releasable responsive to the kickover tool being withdrawn from the side pocket mandrel, to allow the pivot arm to return to its aligned position. The kickover tool is provided with a cam surface formed on its pivot arm and with a novel running tool attached to the outer end of the pivot arm, the running tool having a spring-biased operated rod having its upper end bearing against the cam surface on the pivot arm, the running tool having a body and lock members carried thereby for engaging an instrument for supporting the same, the operator rod having an enlargement thereon for supporting the lock members against movement to releasing position when the pivot arm is in its aligned position, the operator rod being movable to releasing position in response to the pivot arm being moved to extended position so that the enlargement no longer supports the lock members. In one form of the running tool, the lock members are collet fingers with bosses thereon, which will still support the instrument even after the collet fingers are unlocked, the collet being disengageable from the instrument upon the kickover tool being lifted after the instrument has been installed in the receptacle bore of the side pocket mandrel. In another form of the running tool, the lock members are balls or lugs carried in windows of the running tool body. These lugs will no longer support the instrument after they are released by the operator rod. In this running tool friction means such as a friction member, band, or ring is provided on the running tool to support the instrument after the lock lugs have been released. This friction means frictionally engages the instrument and requires considerable pullout force to disengage it therefrom.

A modified form of the instrument is provided with friction means which may be like that provided on the running tool just mentioned. However, the pullout force requirement of this friction member exceeds that of the running tool by a considerable margin. This friction member is provided on the instrument in lieu of the snap ring carried on the other form of the instrument.

A modified side pocket mandrel is provided in which the locking recess has been omitted from the receptacle bore. The friction member of the instrument will frictionally engage in this receptacle bore. It is also engageable in the first described form of side pocket mandrel having the locking recess in the receptacle bore.

A modified form of the kickover tool is provided having an improved orienting key and a spring therefor which allows the key to remain fully functional until the last moment. The spring can also be latched to the key in an inoperative position to facilitate assembly.

It is therefore one object of this invention to provide improved apparatus for monitoring at least one parameter at a downhole location in a well.

It is another object to provide an improved side pocket mandrel for connection into a well tubing, the mandrel having electrical means engageable with an instrument for electrically connecting the instrument to a power supply and other equipment at the surface.

Another object of this invention is to provide such a side pocket mandrel having sufficient space above its receptacle bore to accomnodate the longest instrument currently anticipated to be used for monitoring parameters at downhole locations in wells.

A further object is to provide a side pocket mandrel of the character described having improved electrical connection means.

Another object is to provide an improved kickover tool having means for positively locking the same in its actuated or misaligned position.

Another object is to provide such a kickover tool in which the positive lock means is released automatically in response to the kickover tool being withdrawn from the side pocket mandrel.

A further object is to provide such a kickover tool having improved detent or lock means for maintaining the tool in aligned and misaligned positions.

Another object of this invention is to provide such a kickover tool having improved orienting key means and spring means therefor.

Another object is to provide such a kickover tool having means for catching an instrument carried thereby should such instrument become disengaged from the kickover tool at the improper time in the well.

Another object is to provide such a kickover tool having a pivot arm formed with a cam surface to be engaged by an operator rod of a running tool for unlocking the running tool in response to the pivot arm being pivoted from aligned to misaligned position.

Another object of this invention is to provide a running tool for use with a kickover tool of the character just described, the running tool having a tubular body with a plurality of lock members such as dependent collet fingers each having a boss thereon, these bosses being engageable with a well tool such as the instrument mentioned earlier, said running tool having an operator rod disposed therein for longitudinal movement, this rod having an enlargement thereon which in one position of the rod is disposed in position to support the collet fingers against movement to releasing position and in the other position of the rod the enlargement being in a location where it cannot interfere with the movement of the fingers to releasing position, this operator rod being spring biased to a position holding the collet fingers engaged, the upper end of the operator rod protruding from the upper end of the running tool body being engageable with a cam surface formed on the pivot arm of a kickover tool.

Another object is to provide a similar running tool wherein the lock members are balls or lugs radially movable in windows and being lockable and releasable by the operator rod engaged with the cam on the pivot arm of the kickover tool. This modified form of running tool is further provided with a friction member frictionally engaged with the instrument for supporting the same after the lock members have been released.

Other objects and advantages will become apparent from reading the description which follows and from studying the accompanying drawing wherein:

DESCRIPTION OF THE PREFERRED EMBODIMENTS

Figure 1:
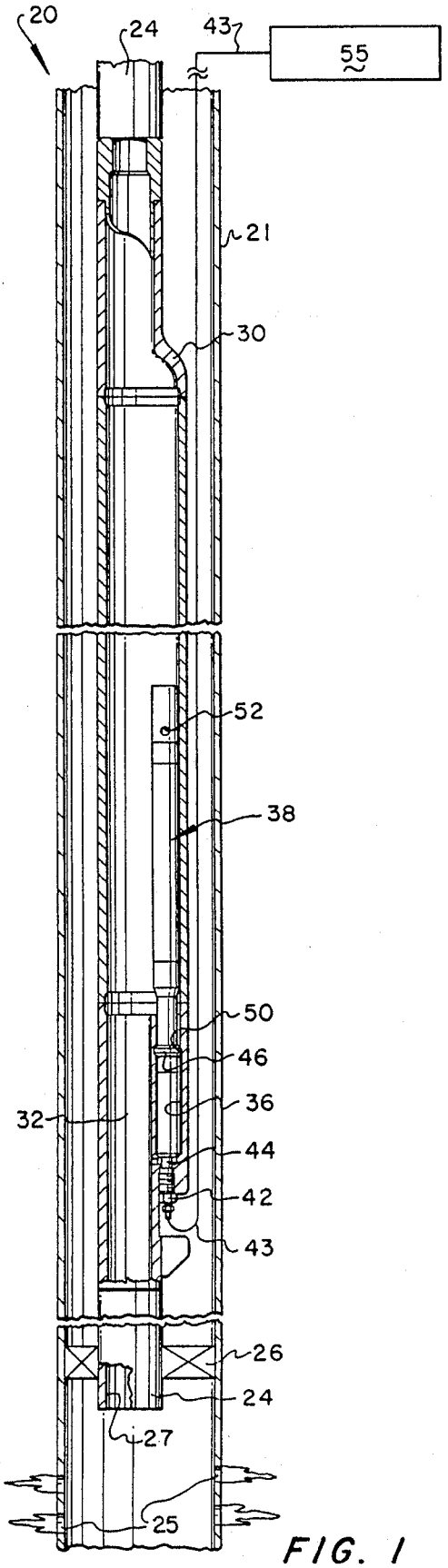
FIG. 1 is a schematical view showing a subsurface portion of a well having means installed therein for monitoring a parameter, pressure or temperature, or the like, and for transmitting appropriate signals to the surface for processing.

Referring now to FIG. 1, it will be seen that the well 20 is provided with well casing 21 in which is installed a well tubing 24. A packer 26 seals the annulus between the tubing 24 and casing 21 in the lower part of the well 20. The annulus may be filled as desired with gas, liquid, mud, or the like. Production fluids from the formation (not shown) enter the casing 21 through perforations 25 below the packer 26 and flow upwardly through the bore 27 of well tubing 24 to the surface.

For monitoring a parameter, such as pressure, and/or temperature, or the like, at a downhole location in the well while receiving values of such parameter of parameters at the surface virtually instantaneously, the well 20 is further provided with equipment which will now be described.

A special form of side pocket mandrel 30 is connected into the well tubing 24 at the desired location to become a part thereof. Thus, production fluids will flow upwardly through the side pocket mandrel on their way to the surface.

Side pocket mandrel 30 is similar to those side pocket mandrels disclosed in U.S. Pat. No. 29,870 to H. H. Moore, et al., U.S. Pat. No. 4,333,527 to Robert S. Higgins, et al., U.S. Pat. No. 4,416,330 to David T. Merritt, et al., as well as U.S. Pat. No. 3,939,075 to Bernard J. P. Glotin, et al., and U.S. Pat. No. 4,105,279 also to Bernard J. P. Glotin, et al., all of which patents are incorporated into this application for all purposes by reference thereto.

The side pocket mandrel 30 has, of course, a main bore 32 extending through it from one end to the other and this main bore is axially aligned with the bore 27 of the tubing. The side pocket mandrel is further provided with a laterally offset receptacle bore 36 for receiving an instrument 38 suitable for monitoring the desired parameter or parameters. Above the offset receptacle bore 36, the side pocket mandrel is shown to have a belly providing ample space for operation of a suitable kickover tool, to be described later, for installing tools such as instrument 38 in or removing such instruments from the receptacle bore.

Similar to the manner taught in U.S. Pat Nos. 3,939,075 and 4,105,279 to Glotin, et al., supra, the lower end of the receptacle is bored and threaded to receive an electrical plug 42 having an upstanding contact member 44, to be described later, to be contacted by the instrument 38. An electrical wire 43 is attached to the outer end of plug 42 and extends to the surface. The instrument 38 has in its lower end a socket which, when the instrument is installed in the receptacle bore 36, telescopes over the upstanding contact member 44, making electrical contact therewith, while the snap ring 46 carried on the instrument 38 snaps into an internal annular recess 50 provided in the receptacle bore. (The instrument 38 makes electrical grounding contact with the receptacle of the side pocket mandrel.) The instrument 38 has at least one lateral port 52 near its upper end for admitting well fluids from the tubing bore into the instrument where suitable sensor means (not shown) is provided.

The side pocket mandrel 30, while similar to several of those disclosed in the prior art mentioned hereinabove, has no lateral port as do conventional side pocket mandrels. Thus, neither the main bore 32 nor the receptacle bore 36 communicates with the exterior of the side pocket mandrel. This special side pocket mandrel 30 complete with the electrical plug 42, contact 44, and the means for adapting the instrument 38 to this equipment, as well as the kickover tool and running tool for installing and removing the instrument in the well, may be furnished by Otis Engineering Corporation, Dallas, Tex.

The electrical wire 43 has its surface end connected to suitable surface equipment, represented by the box 55. Equipment 55 includes a source of electrical energy whereby power may be transmitted via wire 43, plug 42, and contact 44 to the downhole instrument 38. The instrument 38, then senses the parameter or parameters to be monitored and sends electrical signals back to the surface via wire 43. Equipment 55 includes means for processing such signals for immediate display, storage in a memory bank, recording, or the like.

Thus, whether the well is flowing, or not flowing, so long as electrical power is supplied to instrument 38, it will transmit electrical impulses to the surface to indicate the pressure, and/or temperature, or the like parameter, at the location of the instrument in the well. The instrument will ordinarily be programmed to sample the pressure, and/or temperature, or the like, at perhaps closely spaced time intervals and to send appropriate signals to the surface each time a parameter is sampled. Thus, monitoring is virtually instantaneous and in real time. Any change in the parameter being monitored may be immediately reflected at the surface.

Figure 2A:
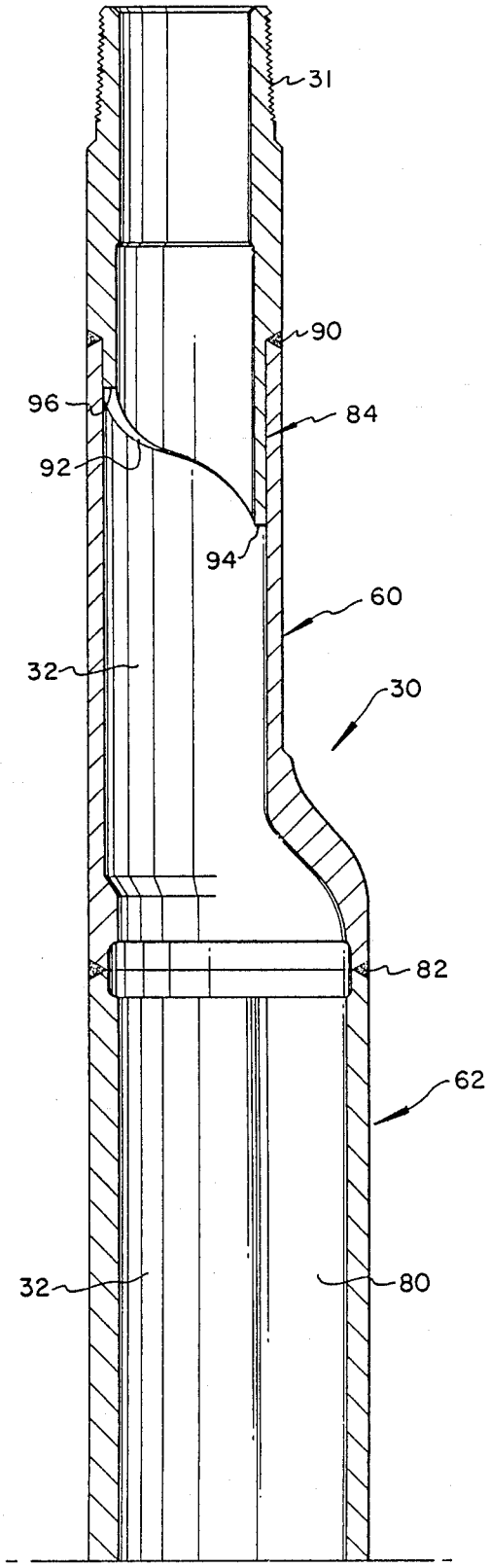
FIGS. 2A, 2B, and 2C, taken together, constitute a longitudinal sectional view showing a receptacle for installation in a well and showing a monitoring instrument in operating position therein.
Figure 2B:
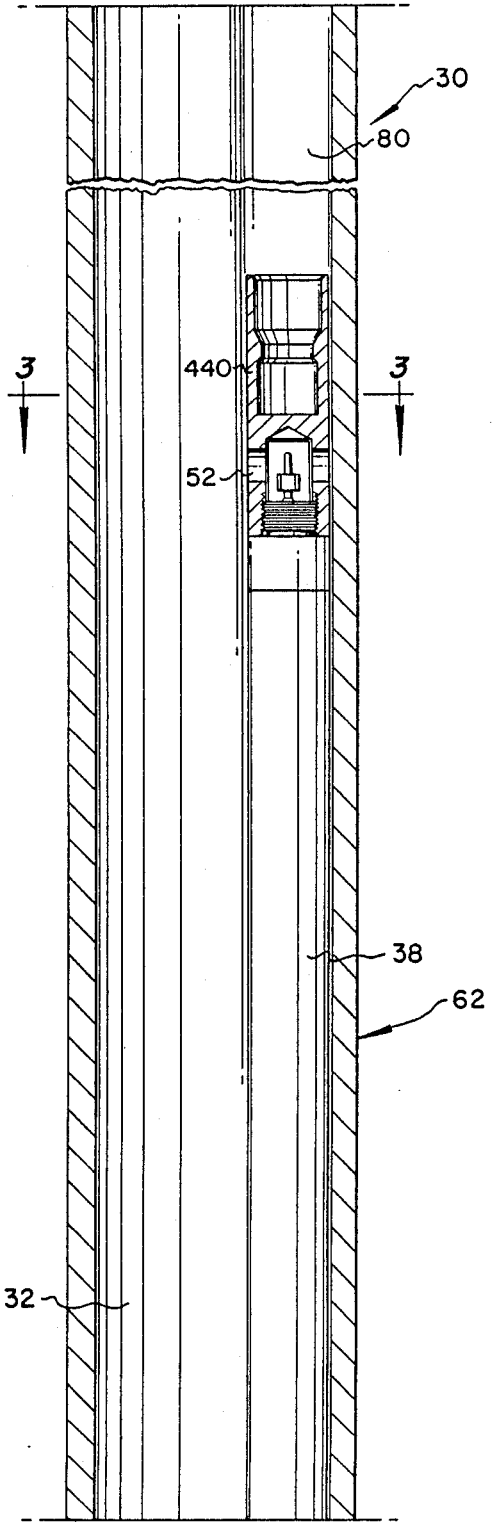
Figure 2C:
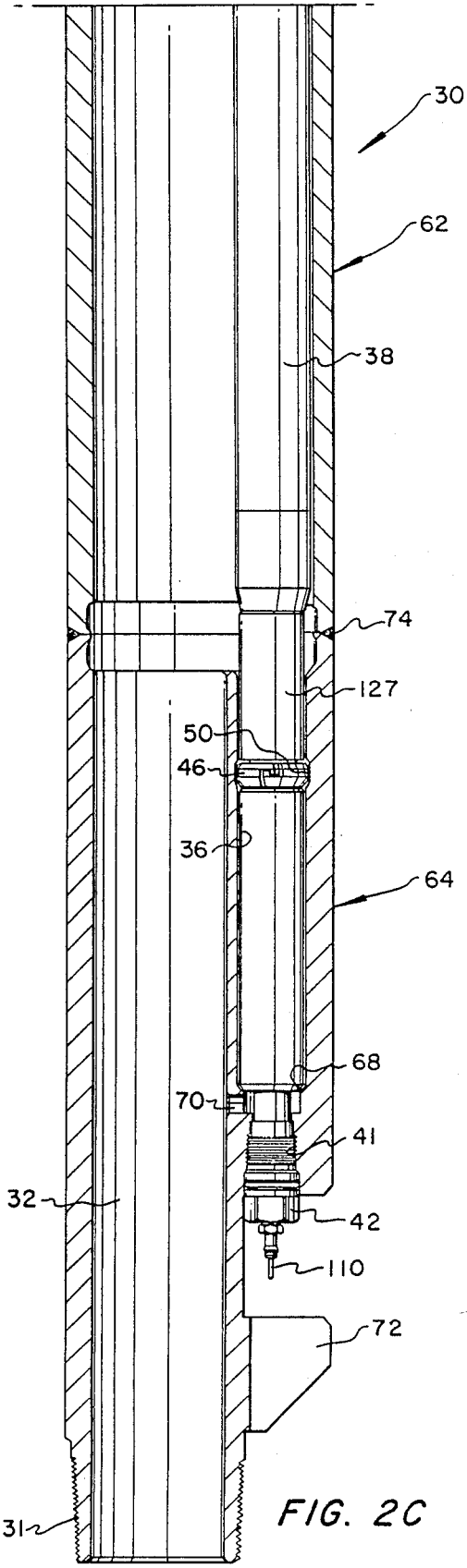

Referring now to FIGS. 2A, 2B, and 2C, the side pocket mandrel 30 and instrument 38 are seen to be illustrated in greater detail.

The side pocket mandrel 30 is provided with means such as thread 31 at its upper and lower ends for attachment to the well tubing 24. A main bore 32 extends the full length of the mandrel 30 and is coextensive with the flow passage 27 through the well tubing. The side pocket mandrel is constructed in a manner very similar to that taught in U.S. Pat. Nos. 4,333,527 and 4,416,330, supra. It is formed of an upper end piece 60, an upper body section 62, and a lower body section 64.

The lower body section is formed of a solid bar of steel or from an extrusion. If formed from a solid bar, the main bore 12 must be machined, drilled, or similarly fashioned. If material for this lower body section is formed by extrusion, the main bore 32 may be formed during the extrusion process. The receptacle bore 36 is then machined substantially parallel to main bore 32 as shown, and so are the other elements thereof, such as the snap ring recess 50, the upwardly facing seat shoulder 68, the threaded opening 41, the drain port 70, the protective lugs 72, the lower thread 31, and the special shape required for completing the circumferential weld 74. The receptacle bore 36 is provided with no lateral port means other than drain port 70 and is otherwise imperforate intermediate its ends and, thus, the interior of the side pocket mandrel 30 has no fluids communication with the exterior thereof.

Figure 3:
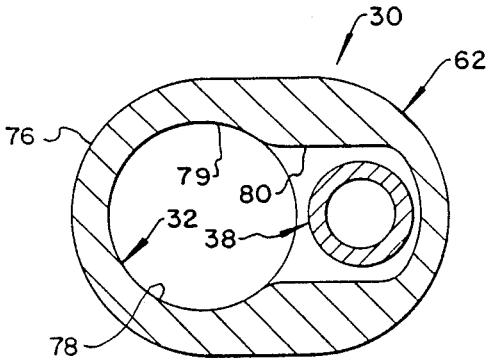
FIG. 3 is a cross-sectional view taken along line 3—3 of FIG. 2B.

The upper body section 62 may be formed from a solid bar of steel, but is preferably formed from an extrusion. A transverse section of this upper body section is seen in FIG. 3. It is seen in FIG. 3 that the outer shape 76 in the upper body section 62 is generally oval, however, a round outer shape may be preferred in large sizes of mandrels if great pressures are to be withstood. The inner shape 78 is much like a cylindrical bore portion 79 with a large longitudinal channel or keyway 80 (as taught in U.S. Pat. No. 4,416,330 to Merritt, et al.) opening thereinto as shown. The keyway 80 is offset from the main bore and in this case houses the instrument 38 in an out-of-the-way location. In addition, the keyway while being of sufficient section to accept the instrument, is sufficiently narrow to protect it from being struck by most ordinary tools which may be lowered into the well tubing. In addition, the upper body section 62 is sufficiently long to accommodate any instrument, such as instrument 38, presently available to the industry.

The upper and lower ends of the upper body section 62 are prepared for welding preferably in the manner taught in U.S. Pat. No. 4,333,527, supra. Its lower end is welded as at 74 to the upper end of the lower body section 64, as before explained. The upper end of the upper body section 62 is circumferentially welded as at 82 to the lower end of the upper end piece 60 after it has been suitably prepared to be so welded.

The upper end piece 60 may, if it is desired to provide means for actuating an orienting kickover tool therein, be provided with an orienting sleeve, such as the orienting sleeve 84. This orienting sleeve 84 may be formed and secured in position in any suitable manner. In the illustrated structure, the sleeve is formed as a separate piece which is then circumferentially welded as at 90 to the upper end of the upper end piece. The orienting sleeve is provided with a pair of guide surfaces 92 which extend from a point 94 upwardly to a high point 96 which may or may not be located 180 degrees from point 94. The two guide surfaces may or may not proceed along right-hand and left-hand helical paths to arrive at the high point 96. The high point is thus shaped like a notch and provides a downwardly facing shoulder 96 to be engaged by an orienting key of a kickover tool for actuation thereof in the well known manner, but which will be explained briefly herein below. The upper end of the orienting sleeve is threaded as at 31 for attachment to the well tubing as before explained.

Figure 4:
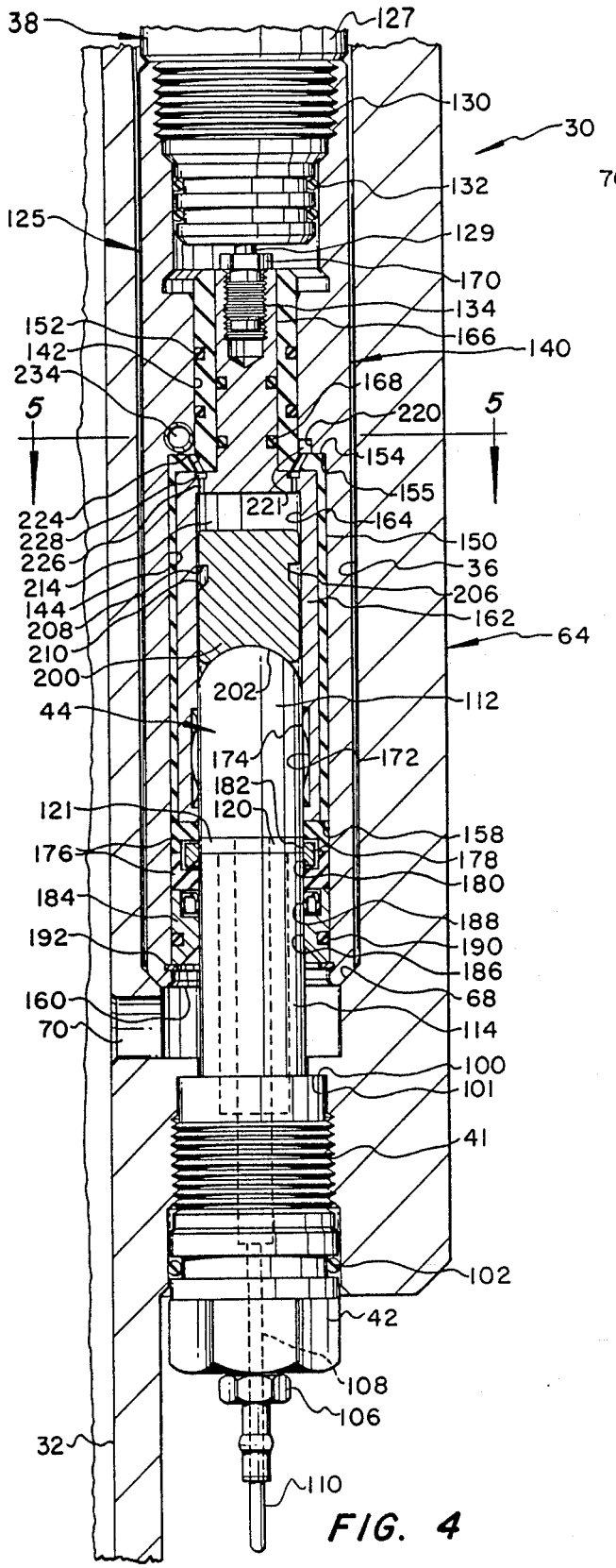
FIG. 4 is a fragmentary longitudinal sectional view showing the electrical connection between the instrument and the receptacle.

The electrical contacts of the side pocket mandrel 30 and the instrument 38 are shown in greater detail in FIG. 4. Referring now to FIG. 4, the electrical plug 42 is secured as by threads 41 in the lower end of the receptacle bore 36 of side pocket mandrel 30 and its upwardly facing seating shoulder 100 is tightened firmly against downwardly facing seating shoulder 101 forming a conventional metal-to-metal seal. A resilient ring, such as o-ring 102 seals about the plug as shown. A connector 106 provides a conductor rod 108 which has its external end exposed as at 110 to be attached to a suitable conductor, such as conductor wire 43, by a suitable connector, such as a snap-on connector (not shown), while its internal end is attached to, or is integral with male contact member 112. The plug 42 has its upper end portion reduced in outside diameter as at 114 and an insulating sleeve 120, having an external flange 121 at its upper end, and formed of a suitable plastic having desired dilectric properties, is disposed between the plug 42 and the male contact member 112 to avoid shunting or short circuiting therebetween and, thus, causing the installation to malfunction.

Thus, an upstanding contact member 44 is provided at the lower end of the receptacle bore. A drain port 70 communicates the receptacle bore 36 with the mandrel's main bore 32 as shown to allow proper drainage and free passage of fluids and solid particles carried thereby.

The female portion 125 of the electrical connector is carried on the extreme lower end of the instrument 38. The instrument 38 is connected to this female portion 125 of this connector by a coupler 127 having electrical conductor means 129 extending therethrough to electrically connect the instrument 38 to the female portion 125 of the electrical connector. The coupler is attached between the instrument and the electrical connector by threads 130 and is sealed by resilient seal rings 132. The electrical conductor 129 of the coupler 127 is preferably spring loaded and its lower end is firmly pressed into a recess or blind hole in the upper end of contact plug 134 and shouldered therein to assure good and uninterrupted electrical contact.

The coupler 127 is provided with a suitable external annular recess 50 in which the snap ring 46 (see FIG. 2C) is carried and by which the instrument is retained in position in the receptacle bore 36.

The female portion 125 of the connector includes a housing 140 having a bore 142 therethrough. Bore 142 is enlarged and threaded at its upper end as at 130 for attachment to coupler 127. Bore 142 has its lower portion enlarged as at 144. Within bore 142 and its lower enlarged portion 144, a female electrical receptacle is provided, which will now be described.

An insulating sleeve 150 is placed within the body 140 and a pair of resilient seal rings 152 seal between the body and the insulating sleeve as shown. An external annular shoulder 154 on the sleeve engages a corresponding downwardly facing shoulder 155 to limit upward movement of the sleeve 150 in the housing. The lower end 158 of the sleeve, as seen in FIG. 4, is spaced a short distance from the lower end 160 of the housing.

A conductor socket member 162 is positioned inside the insulating sleeve 150 as shown. This member has a downward-opening blind bore 164 for receiving the upstanding contact member 44 of the mandrel in a manner to be explained. Just above the point where bore 164 terminates, the conductor socket member 162 is reduced in outside diameter as at 166 and this reduced diameter portion has a pair of seal ring recesses formed therein in which resilient seal rings 168 are disposed to sealingly engage the inner wall of insulating sleeve 150 as clearly seen in FIG. 4. The upper end of member 162 is drilled and threaded for attachment of plug 170. Plug 170 is provided with a suitable recess or bore for receiving the lower end of spring-loaded conductor rod 129 of coupler 127 as explained earlier.

Near its lower end, conductor socket member 162 is formed with an internal annular recess 172 in which is disposed a contact member 174 which is formed of spring brass or other suitable conductive material and may be gold plated if desired. This member is shaped to be an interference fit with the upstanding conductor member 44 and its springiness assures good contact with both the member 44 and the conductor socket 162. (Contact bands or members such as contact member 174 are available from Hugin Industries, Inc., Los Altos, Calif.)

The lower end of the conductor socket member 162 is substantially even with the lower end of the insulating sleeve 150. Below their lower ends is a pair of insulator rings 176 which may be shaped identically and when assembled as shown provide an internal annular recess in which is positioned a snap ring 178 having its bore chambered at its lower end as shown to provide a cam shoulder 180 while the upper end of its bore is left unchamfered to provide a square stop shoulder 182. The purpose of this snap ring 178 will be later brought to light.

Below the pair of insulator rings 176, a ring 184 is positioned in the enlarged bore 144 of the housing 140. This ring 184 has a bore 186 enlarged at its upper end as shown to receive and house a one-way seal ring 188. The ring 184 is formed with an external recess in which is disposed a seal ring such as o-ring 190 for sealingly engaging the inner wall of the housing as shown. The ring 184 is retained in place by a retaining ring 192 engaged in a suitable internal annular groove in the inner wall of the housing 140 as seen in the drawing. The ring 184, the insulator rings 176, and the snap ring 178 each have a central opening for receiving the upstanding contact member 44 as shown.

In order to assure good, clean contact between the instrument 38 and the upstanding conductor member 44, well fluids, salt water, mud, acids, and other unclean and/or noninsulating liquids must be excluded from the contact areas at the time that the instrument is installed and the lower open end of the instrument is telescoped down over the upstanding contact member 44 in the lower end of the receptacle bore 36 in the side pocket mandrel. Means for accomplishing such good, clean connection are provided and will here by explained.

A piston 200 is slidably disposed in the bore 164 of the conductor sleeve 162. This piston has a concave lower surface 202 which conforms substantially to the rounded upper end surface of contact member 44 and the lower outer edge of the piston is rounded to form an annular cam surface which will allow the lower end of the piston to pass through snap ring 178, the inside dimension of the snap ring being inherently smaller than the outer diameter of the piston but being expandable or spreadable to accommodate the piston. The piston 200 is formed with an external annular recess 206 thereabout. This recess has its upper wall normal to the piston's longitudinal axis, thus forming a square downardly facing shoulder 208. The lower wall of this recess is beveled as at 210 to provide a cam shoulder. When the instrument is being lowered into the well, the piston 200 is held in its lower position (not shown) by the snap ring 178 engaged in its external recess 206. Thus, it is supported against further downward movement since the square shoulder 182 at the upper corner of the snap ring 178 engages the square shoulder at the upper side of the recess 206 on the piston to define its initial lower position.

The cavity or space 214 in the bore 164 above piston 200 is filled completely with clean, non-conducting liquid such as a silicone liquid or a suitable non-conductive grease. It may be desirable for the density of this liquid to be slightly less than that of the well liquids to be encountered. The liquid in space 214 will then be buoyed upward and will be retained in its place more readily. When the piston 200 is in its initial lower position (not shown) and held in place by snap ring 178, the periphery of the lower portion of the piston is engaged by one-way seal ring 188 to discourage the non-conducting fluid from migrating out of its place in the instrument.

When the instrument 38 is forced down into the receptacle bore 36, the lower open end of the instrument starts to telescope over the upstanding contact member 44. The member 44 immediately engages the lower end of the piston. As the instrument is forced further downward, the fluid above the piston is compressed and then displaced. Space 214 is closed above the piston. The only route of escape for the insulating fluid is downward about the piston, and to do this the liquid must be forced downward between the piston and the one-way seal ring 188. As the non-conducting liquid is thus displaced, it displaces ahead of it all other liquids, oil, salt water, water, mud, and the like, so that when the instrument is fully seated, as seen in FIG. 4, there will be good, clean contact between the contact member 174 and the contact area of the male contact member 112. In addition to the washing action just mentioned, the contact areas are wiped clean as the mating parts are telescoped together.

Downward movement of the instrument relative to said side pocket mandrel is arrested when the lower end 160 of the instrument 38 engages upwardly facing inclined shoulder 68 in the receptacle bore 36.

In order to facilitate the disconnection of the instrument 38 from the upstanding male contact member 44, means are preferably provided for allowing well fluids to re-enter the space 214. Since the one-way seal 188 will not allow fluids to re-enter the space 214, other means of re-entry is needed.

The housing 140 is provided with a passageway communicating the upper end of space 214 with the exterior of the instrument 38 as will be described, and this passageway has a check valve therein which will permit fluids to pass inwardly therethrough but will not allow fluids to move therethrough in an outward direction.

At the level of the downwardly facing shoulder 155 in the body, the body is provided with a short intermediate bore 220. This short bore understandably provides an annular recess 221 which may be better seen in FIG. 5. This recess 221 is in direct fluid communication with the space 214 above piston 200 via a plurality of holes 224, through the insulator sleeve 150, and a plurality of holes 226 in the conductor sleeve 162, as shown. An annular recess 228 is formed in the conductor sleeve to facilitate the movement of fluids between holes 224 and 226.

The body 140 is provided with a passage through its wall to fluidly communicate recess 221 with the exterior of the housing. This passage is provided in the form of an off-center transverse hole 230 which is clearly seen in FIG. 5. One end of hole 230 is plugged by suitable means, such as screw 232. A check valve assembly 234 in passage 230 permits the flow of fluids into the interior of housing 140 as indicated by the arrows but will not permit outward flow therefrom.

Figure 5:
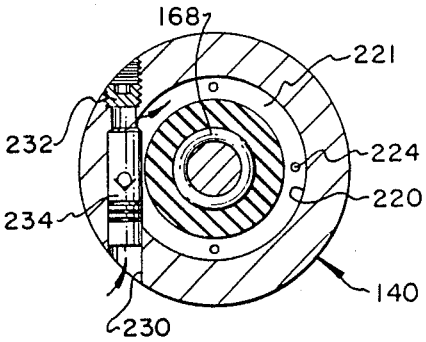
FIG. 5 is a cross-sectional view taken along line 5—5 of FIG. 4.

The check valve, such as check valve assembly 234, may be of the type which is swaged into place. Such precision check valves and swaging tools are available from The Lee Co., Westbrook, Conn. The symbol for a check valve has been superimposed upon check valve assembly 234 as seen in FIG. 5 to further indicate its function.

Thus, when piston 200 is moved upwardly in the bore 164 of the conductor sleeve 162 as a result of the lower open end of the instrument being telescoped down over the upstanding contact member 44, the non-conducting liquid above the piston cannot flow through check valve assembly 234 so it must flow downwardly around the piston and the upstanding contact member 44. This washes the well fluids, oil, salt water, and the like substances, out of the contact area as before explained. When, however, the instrument 38 is lifted relative to the upstanding contact member, well fluids will flow from the exterior of the instrument, through passage 230 and check valve assembly 234, into recess 221. From there it flows through holes 224, recess 228, and holes 226 into space 214 to fill the void created by such upward movement of the instrument relative to the upstanding contact member. This facilitates making the disconnect for removal of the instrument from the well.

The instrument is installed in and removed from the side pocket mandrel 30 through use of a suitable kickover tool lowered into the well by suitable means, such as a wire line (not shown) and a string of wireline tools (not shown). Wire line and wireline tools are well known and have been used for many years to install subsurface flow controls, safety devices, and other well tools in wells.

Although existing kickover tools might be used to install an instrument, such as instrument 38, in the side pocket mandrel 30 of well 20, the kickover tool of FIGS. 6A–10B is particularly suitable for this task and has special features which will handle the very expensive and delicate instrument with a good degree of safety.

Referring now to FIGS. 6A through 10B, it will be seen that the kickover tool of this invention is indicated generally by the reference numeral 300. Kickover tool 300 is similar to the kickover tool disclosed in the above-mentioned U.S. Pat. No. 4,442,893 to Foust, which patent is incorporated herein by reference for all purposes.

Kickover tool 300 includes an elongate body 302 having means, such as thread 304 on its upper end for attachment to a tool train such as tool train 306. Body 302 has a flat surface 310 which extends from its lower end 311 to a location near its upper end where it meets abrupt downwardly facing shoulder 312. Body 302 is formed with a longitudinally extending slot 314 which is enlarged as at 316.

An elongate actuator 320 has a flat side 322 which extends from its upper and downward almost to its lower end. The body 302 and the actuator are assembled as shown with their flat sides 310 and 322 in confronting relation by suitable means such as a bolt/slot arrangement or a T-slot arrangement. In the kickover tool 300, a shoulder bolt 324 passes through slot 314 of the body and is tightened in threaded aperture 326 of the actuator 320, as shown, to hold the body and actuator in close but freely sliding relationship. The head of bolt 324 slides in the enlarged portion 316 of slot 314. The actuator is slidable between an upper position, seen in FIG. 6A wherein the upper end of the actuator abuts or substantially abuts the downwardly facing shoulder 12 at the upper end of body flat 310 and a lower position, seen in FIGS. 8A and 8B, which will become clear later.

Figure 6A:
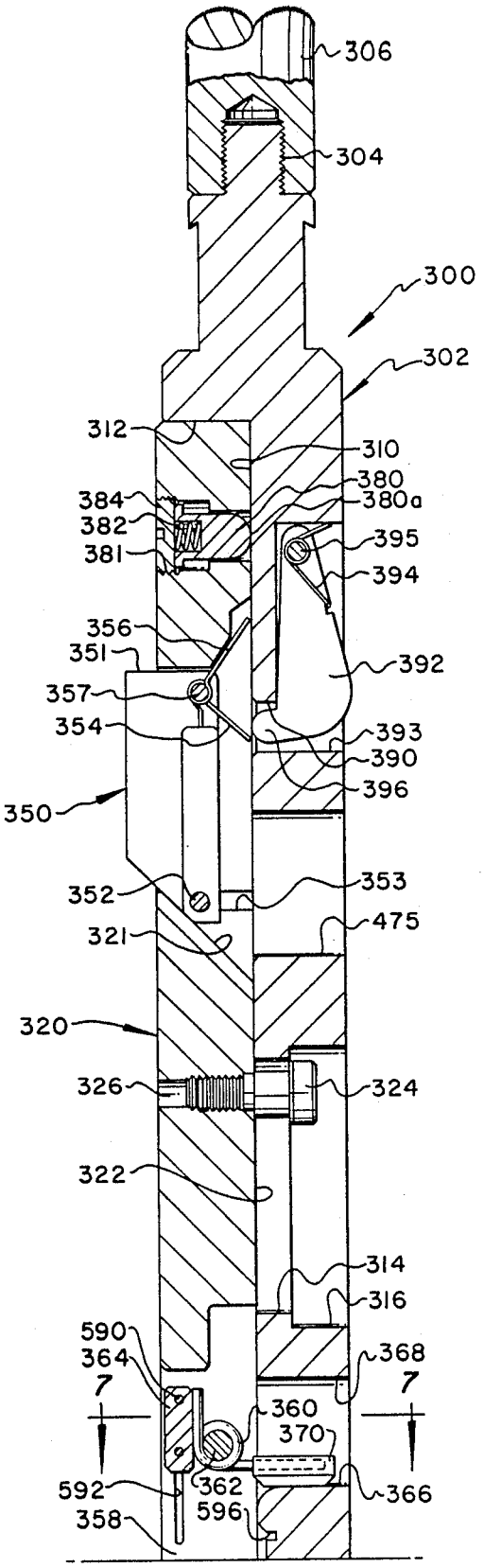
FIGS. 6A, 6B, and 6C, taken together, constitute a longitudinal view, partly in section and partly in elevation showing the kickover tool and running tool of this invention as they would appear while lowering an instrument into a well.
Figure 6B:
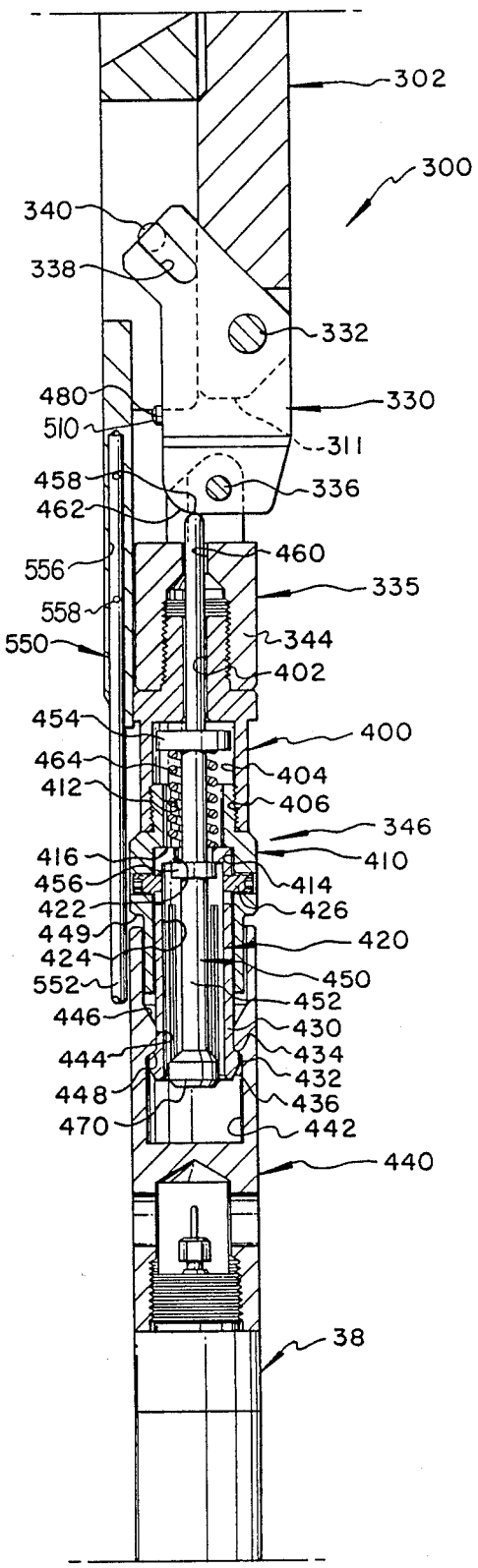

A pivot arm 330 is pivotally attached as by pivot pin 332 to the lower bifurcated end of body 302 and tool carrier means 335 is hingedly attached as by pivot pin 336 to its free or lower end as seen in FIG. 6B. The inner end of pivot arm 330 is formed with slot means 338 which is engaged with pin 340 carried on the actuator 320. It may now be readily seen that when the actuator 320 moves downwardly relative to the body 302, the pin 340, moving downwardly relative to the pivot arm 330, will cause the pivot arm to pivot about pivot pin 332 in a counter-clockwise direction. When actuator 320 reaches its lowermost position, seen in FIGS. 8A and 8B, the pivot arm will be in its kickover position wherein its free end extends outwardly from the body at substantially 90 degrees, as shown. As the pivot arm swings outwardly toward kickover position, the tool carrier means 335, being hinged thereto remains in a pendent position as seen. Thus, as the pivot arm pivots to misaligned position to tool carrier means pivots in a clockwise position and thus remains substantially parallel to the longitudinal axis of the kickover tool. In FIGS. 6A–8A, the tool carrier means includes a carrier 344 and a running tool 346 from which is suspended an instrument 38 which may be like the instrument 38 previously introduced for monitoring the well pressure and/or temperature.

Figure 6C:
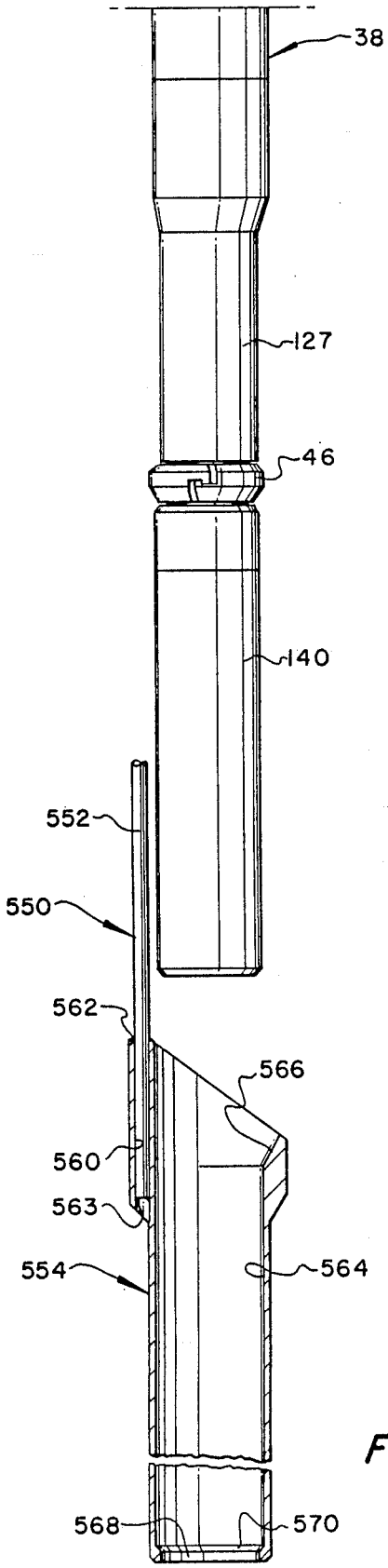
Figure 7:
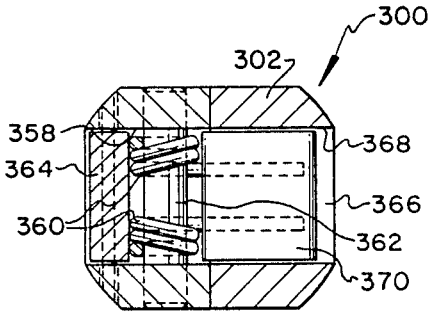
FIG. 7 is a cross-sectional view taken along line 7—7 of FIG. 6A.
Figure 9:
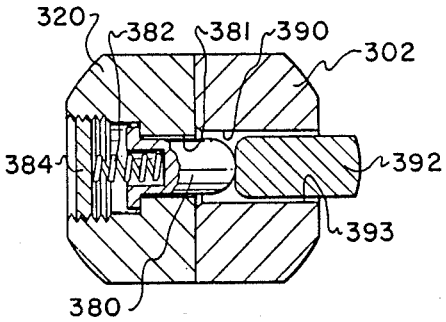
FIG. 9 is a cross-sectional view taken along line 9—9 of FIG. 8A.

It is readily seen that when the kickover tool 300 is actuated, as by moving the actuator 320 thereof downward relative to its body 302, the tool carrier means and instrument are moved from a running position wherein they are axially aligned with the kickover tool, and therefore with the tubing bore as seen in FIG. 6A–6C, to a kickover a misaligned position wherein the tool carrier means and the instrument are laterally displaced to a position of axial alignment with the offset receptacle bore 36 of the side pocket mandrel 30.

The kickover tool 300 is provided with an orienting finger or key 350, having a square upwardly facing end 351, and attached as with pin 352 which has its ends slidable in a suitable slot such as slot 353 formed in actuator 320. The key 350 can pivot about pin 352 and the pin can slide in slot 353 as needed. The orienting key is initially biased outwardly by spring means including a first spring 54 and a second spring 356 which provides a lesser bias than does the first spring. Both springs, 354 and 356 are wound about pin 357 which is carried in a suitable aperture of orienting key 350 as shown. In an emergency, a large force applied to the orienting key as by the key repeatedly engaging stop shoulder 96 in the mandrel, the pin 352 will shear and as the key moves downwardly relative to the actuator, the cam surface 321 will force the orienting key to fully retracted position.

In addition detent means are provided for detenting the actuator 320 in its uppermost and also in its lowermost position relative to the body 302.

A pair of detent springs 360, disposed in slot 358 of the actuator, is wound around pin 362 and each spring has one of its ends supported against stop block 364 while its other end applies a downward force to the upwardly facing surface 366 at the lower end of slot 368 in body 302 as seen in FIG. 6A. See also FIG. 7. It may be desirable to provide means such as cam block 370 on the end of the springs 360 as shown to provide better bearing area and improve the operation of the tool. By applying a downward force to surface 366 of the body, the springs 360 also apply an upward force to pin 362 which tends to lift the actuator and maintain it in its uppermost position relative to body 302.

The kickover tool as seen in FIGS. 6A–6C is lowered into the well tubing 24 as through use of a wireline and tool string until upwardly facing shoulder 351 of the orienting key 350 is below the guide surface 92 of orienting sleeve 84 in the side pocket mandrel 30. The kickover tool is then lifted with care. The shoulder 351 of orienting key 350, which is spring-pressed outwardly, will engage the guide surface 92 of the orienting sleeve 84 and will follow it, rotating the kickover tool about its longitudinal axis until the orienting key engages the apex indicated by downwardly facing shoulder 96 of the orienting sleeve and can advance upwardly no farther. Further lifting causes the body 302 to move upwardly relative to actuator 320, overcoming the detent force of detent springs 360. As this relative longitudinal movement occurs between the actuator and body, the pivot arm 330 is swung outwardly and the tool carrier means 335 and instrument 8 are moved to a laterally displaced or offset position, seen in FIG. 8B. In this offset position the tool carrier means and instrument are outside the main bore 32 of the side pocket mandrel and are within the vertical channel 80 where they are suspended poised above the open upper end of the receptacle bore 36.

Figure 8A:
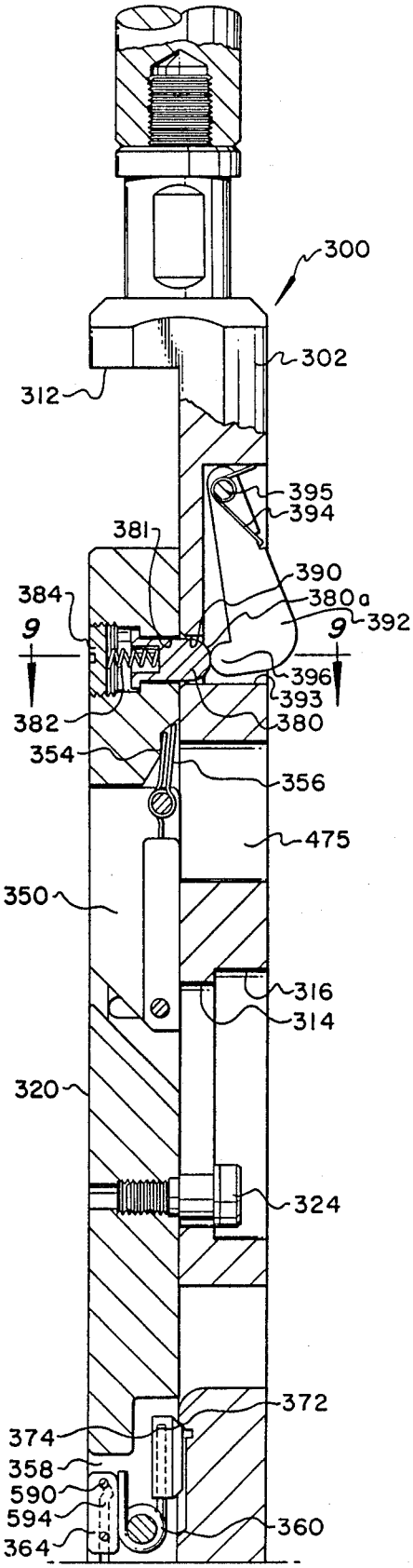
FIGS. 8A and 8B, taken together, constitute a fragmentary longitudinal sectional view of the kickover tool and running tool of FIGS. 6A, 6B, and 6C in misaligned kickover position supporting the instrument in a laterally displaced position.

When the body 302 was lifted to its uppermost position relative to the actuator 320, the cam block 370 on detent spring 360 snapped into its position shown in FIG. 8A wherein its upper cam shoulder 372 engaged a corresponding cam shoulder 374 on the actuator 320 to detent or latch the actuator in its fully actuated position.

At the same time, when the body 302 reached its uppermost position relative to the actuator, other means became effective to positively lock the kickover tool in its fully actuated position. This lock means includes a lock plunger 380, having a rounded nose **380*a* slidable in aperture 381, and which is biased inwardly by a spring 382 retained in place by a screw 384 engaged in the enlarged and threaded outer end of aperture 381. When the spring 382 moves the plunger to its innermost position, seen in FIG. 8A, the plunger will extend beyond the flat surface 322 of the actuator. When the actuator 320 reaches its lowermost position relative to the body 302, a hole 390 in the body aligns with the aperture 381 of the actuator and the plunger 380 is forced by spring 382 to enter into hole 390 of the body. The actuator and body are thus locked together and there can be no relative longitudinal sliding movement between them until the plunger 380 is retracted or displaced from hole 390. This can only happen after the kickover tool has been fully actuated to align hole 390 with the lock plunger 390 and after the kickover tool has been lowered into the side pocket mandrel 30 sufficiently to allow the release lever 392 to move outward of the kickover tool considerably further than the confining bore 37 of the well tubing 24 will allow. The channel 80** in the side pocket mandrel provides room for this to occur.

Figure 10A:
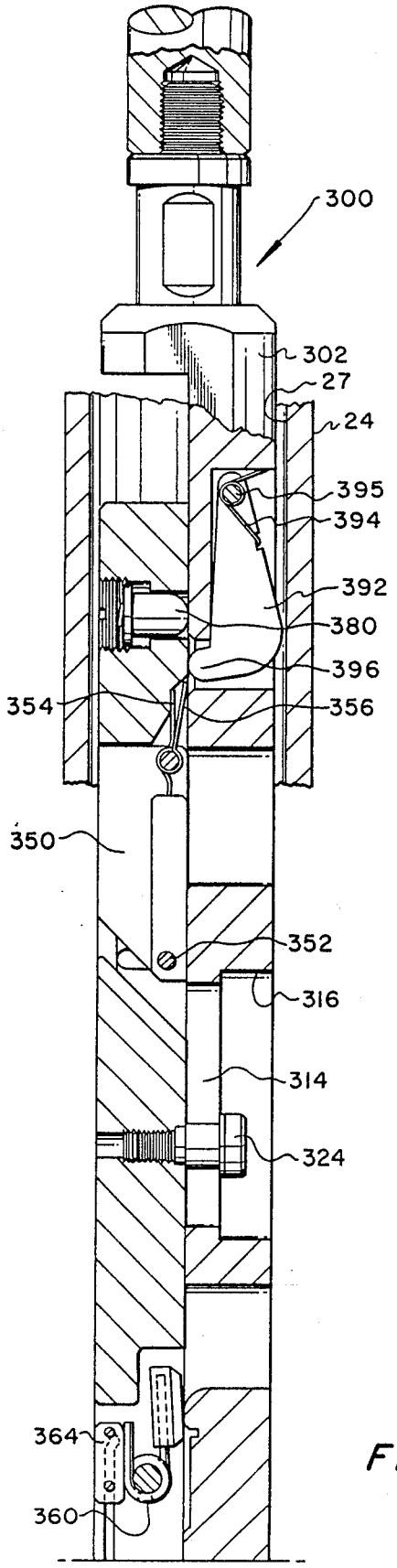
FIGS. 10A and 10B, taken together, constitute a view similar to FIGS. 8A and 8B, but showing the kickover tool being restored to aligned position as it is lifted out of the side pocket mandrel of FIGS. 2A, 2B, and 2C.

It is clearly shown in FIGS. 6A, 9A, and 10A, that release lever 392 is disposed in slot 393 of body 302 and is pivotally mounted to the body by pivot pin 395. Lever 392 is biased toward retracted position by spring 394 wound around pivot pin 395. A projection or finger 396 is formed on the lower end of the lever 392 as shown, and when this lever swings in a clockwise direction the finger 396 is able to project into hole 390. Lever 392 is normally held retracted by spring 394 so that it will not become unduly worn by being dragged along the inner wall of the tubing. When the kickover tool is thus in the bore of the tubing, the confining wall of the tubing will not allow lever 392 to move outward sufficient to clear the hole 390. At such time, the lock plunger 390 cannot engage in the hole 390 even though the hole and plunger may be aligned, as when the kickover tool is at first fully actuated and the orienting key 350 is still at or near downwardly facing shoulder 96 of the orienting sleeve. If, however, the kickover tool is lowered slightly, while in the actuated condition, to a position, seen in FIGS. 8A–8B, wherein lever 392 is no longer confined by the tubing bore, but is able to move outward into the enlarged cavity of the side pocket mandrel, that is, into channel 80, the spring 392 being stronger than spring 394 can force the lock plunger 390 into hole 390 and displace the lever 392 as it is forced to pivot in a counter-clockwise direction and thus protrude much farther beyond the periphery of the kickover tool. The presence of lock plunger 380 in the hole 390 will prevent relative longitudinal movement between the body and actuator and thus releasably lock them in actuated relation. Thus securely locked, the kickover tool may transmit upward or downward forces to the instrument through its pivot arm extended at substantially 90 degrees and through the running tool attached thereto by the tool carrier.

When the kickover tool is lifted so that lever 392 re-enters the confining main bore at the upper end of the side pocket mandrel, lever 392 will engage the inner wall 27 of the tubing 24 and will be cammed inwardly, displacing the lock plunger 380 to a position where it no longer is engaged in hole 390 and, thus, cannot prevent relative longitudinal movement of the actuator relative to the body. Thus, this lock becomes automatically released responsive to lifting the kickover tool from the side pocket mandrel.

Figure 10B:
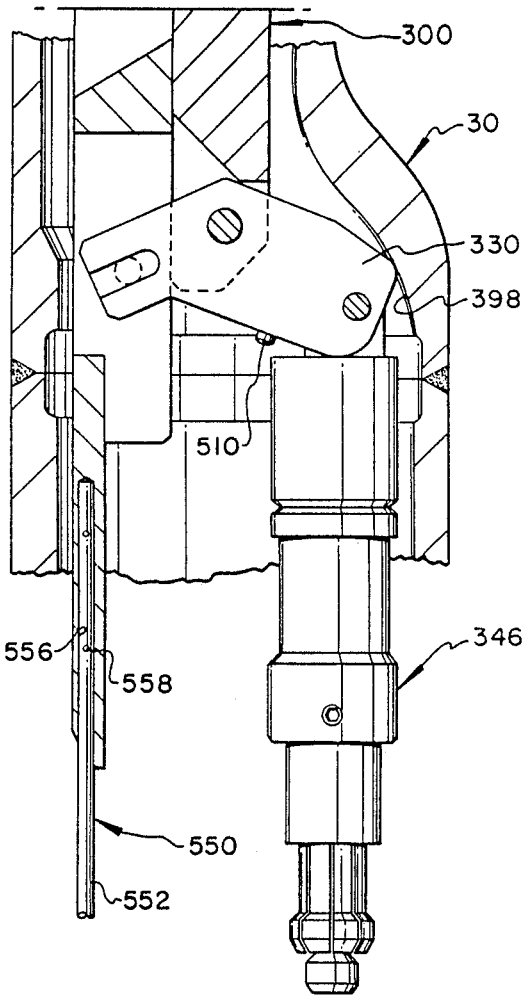

During withdrawal of the kickover tool from the side pocket mandrel, the pivot arm must be returned to its aligned, or FIG. 6B, position. Since the lock plunger 390 has already been released or retracted from hole 390, the pivot arm will be forced to aligned position when its outer end engages the restriction as at 398 near the top of the side pocket mandrel, as seen in FIG. 10B. As the kickover tool is again in its FIG. 6B position, the detent spring 360 will again be effective to maintain the kickover tool in that position.

The running tool 346 attached to the outer end of pivot arm 330 releasably attaches the instrument 38 to the kickover tool 30.

The running tool 346 includes a top sub 400 having a bore 402 which is enlarged as at 404 and threaded as at 406 for attachment to the upper end of body or housing 410. Body 410 has a bore 412 which is enlarged as at 414 providing a downwardly facing internal annular shoulder 416 whose purpose will be later explained.

A collet 420 having a bore 422 which is enlarged as at 424 is disposed in the enlarged bore 414 of housing 410, and its upper end may abut downwardly facing internal shoulder 416 as shown. Collet 420 is secured in position within the body by some suitable means such as pins, screws, or the like, so that it may be readily and more economically replaced if necessary. As shown, the collet is secured by screws 426 threaded into suitable body apertures and having their inner ends engaged in suitable recesses, holes, or slots formed in the collet.

The collet 420 is formed with a plurality of dependent fingers 430 each having an external boss 432 providing an upwardly facing shoulder 434 which is inclined upwardly and inwardly and a downwardly facing shoulder 436 which is inclined downwardly and inwardly. The upwardly facing shoulder 434 is more abrupt than is the downwardly facing shoulder 436 for a purpose to be described. The collet fingers releasably engage the instrument 38 as shown. The instrument is provided with an upper end member 440 having an upwardly opening blind bore 442 having an internal annular ridge or flange 443 constituting what is commonly termed an "internal fishing neck". This fishing neck provides an upwardly facing shoulder 446 which is inclined downwardly and inwardly and a downwardly facing shoulder 448 which is inclined upwardly and inwardly as shown. The downwardly facing shoulder 448 is more abrupt than is the upwardly facing shoulder 446. Thus, the collet fingers may be moved into engagement with the internal fishing neck of the instrument with somewhat less force than that required to disengage it.

Body 410 of the pulling tool is formed with an external downwardly facing shoulder 449 which is engageable with the upper end of the instrument 38 to limit the downward movement of the collet relative thereto.

To lock the collet fingers engaged in the instrument and to unlock them, a control rod and spring are used, as will now be explained.

A control rod 450 is disposed within the pulling tool 346. The control rod comprises a rod body 452 having a large external upper flange 454 and a smaller lower external flange 456 intermediate its ends. The upper end of the control rod is rounded as at 458 and protrudes through bore 402 of the upper sub 400 and through bore 460 of the carrier 335 attached to the pivot arm 330 of the kickover tool. The upper end 458 of control rod 450 which protrudes from bore 460 of the carrier is engageable with cam surface 462 formed on the lower corner of the pivot arm as shown. The control rod is urged upwardly by biasing means such as coil spring 464 disposed in bore 412 of the pulling tool housing 410 and surrounds control rod 450 between its upper and lower flanges 454 and 456, as shown. The lower end of the spring 414 is not supported on lower flange 456 but is supported by the upper end of the collet 420 while its upper end is engaged with the lower side of the control rod upper flange 454 to apply an upward force to the control rod to maintain its rounded upper end 458 in engagement with the cam surface 462 on the pivot arm of the kickover tool.

The lower end of the control rod 450 is enlarged to provide a knob or expander 470 whose upper and lower edges or corners are preferably chamfered as shown. The knob 470 is small enough to be disposed betweenw the lower ends of the collet fingers 430 as shown in FIG. 6B, yet is sufficiently large in diameter to prevent the lower ends of the collet fingers from being forced inwardly sufficiently to permit them to disengage and be withdrawn from the internal fishing neck of the instrument 38. It may be desirable to form knob 470 as well as upper flange 454 as separate pieces and then fasten them to the control rod by suitable means such as threads, pin, or the like.

Figure 8B:
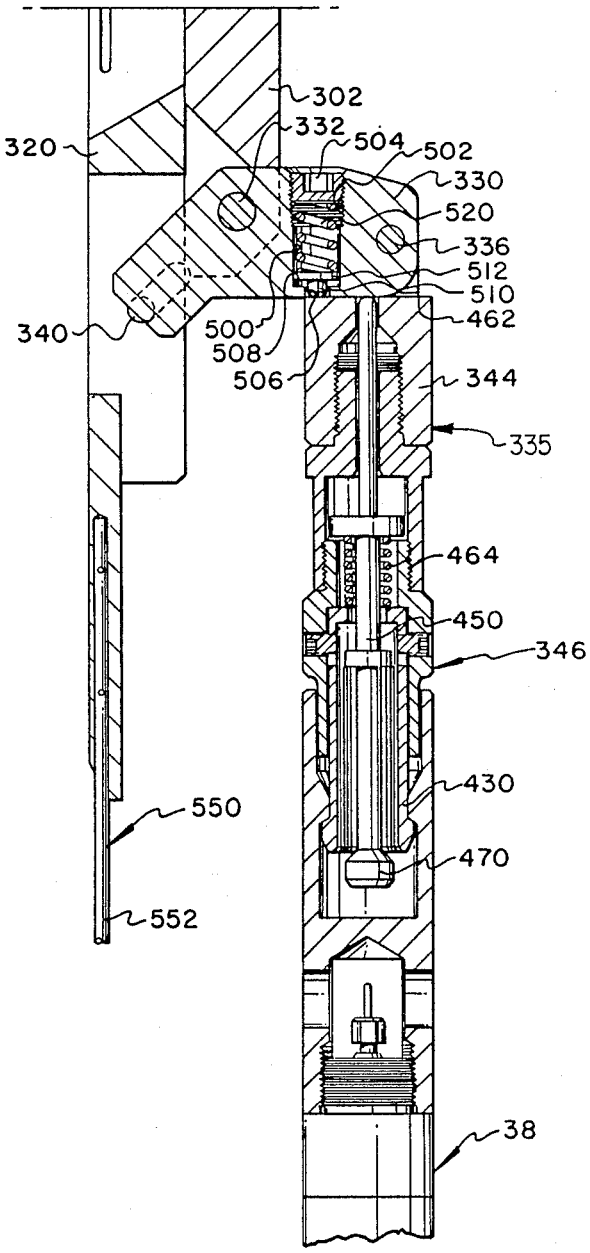

When the kickover tool 300 is actuated from its aligned position, seen in FIGS. 6A–6C, to its kickover position, seen in FIGS. 8A–8B, and the pivot arm 330 is extended at about 90 degrees to the kickover tool while the tool carrier, pulling tool, and instrument remain in their vertical position, the cam surface 462 of the pivot arm will force the control rod 450 of the pulling tool to its lowermost position, seen in FIG. 8B. In the FIG. 8B position, the knob on the lower end of control rod 450 can no longer support the lower ends of the collet fingers against inward movement. In this case, the collet can be disengaged from the instrument by merely lifting the kickover tool provided the instrument is held in the receptacle.

In installing the instrument in the side pocket mandrel, the kickover tool is prepared as seen in FIGS. 6A–6C. In preparation, the kickover tool is actuated to swing the pivot arm outward, the carrier is swung downward (clockwise) to its pendent position to move the control rod to its releasing position, the upper end of the instrument is telescoped over the lower end of the collet to attach the instrument to the running tool, the release lever 392 is depressed to unlock the actuator from the body, and then the kickover tool is operated to its running position, as seen in FIGS. 6A–6C, to permit the control rod 450 to move up under the bias of spring 464 to collet locking position, thus securely locking the instrument to the kickover tool.

The kickover tool and instrument are attached to a tool string and lowered into the well to a level where the orienting key is below the orienting sleeve in the side pocket mandrel. The kickover tool is then lifted to engage its orienting key with the orienting sleeve to orient the kickover tool with respect to the receptacle bore and is further lifted to actuate the kickover tool to kickover position. When the kickover tool reaches fully actuated position, the spring 354 will then have space, provided by slot 475 in the body, to allow it to unwind a little as its inner end moves about pin 352*a* until it comes to bear against the actuator. Spring 354, which is stronger than spring 356 now applies an inward bias to orienting key 350 which overcomes the outward bias of spring 356 and causes the key 350 to move to its fully retracted position, seen in FIGS. 8A and 11A. This is substantially the same procedure taught in U.S. Pat. No. 4,442,893 to Foust, which is incorporated herein for all purposes by reference thereto.

The instrument is now within channel 80 and in alignment with the receptacle bore and can be lowered thereinto. The collet is unlocked, but still supporting the instrument. The kickover tool is lowered. The instrument is forced into the receptacle bore 36. Electrical contact is made. The snap ring 46 on the instrument engages in the receptacle bore lock recess 50 to hold the instrument in place. The kickover tool is lifted to withdraw the collet from the instrument and is withdrawn from the well. After removal of the kickover tool and tool string from the well, the electrical power may be turned on and electrical energy transmitted through wire 43 to instrument 38 downhole. Instrument 38 will utilize this electrical energy and will respond to the well pressure and/or the temperature in the side pocket mandrel. The instrument will then generate appropriate electrical signals which are then transmitted through wire 43 to surface equipment 55 at the surface for processing and subsequent display, readout, and/or storage in a memory bank or on tape.

In a well whose bore deviates appreciably from the vertical, it is possible that a side pocket mandrel such as the mandrel 300 may be located in the deviated portion of well bore. It is further possible that the receptacle bore of such mandrel may be located at the upper side of the mandrel. It may be difficult for the kickover tool to "aim" the instrument into the receptacle bore since because of the slant, the instrument may "sag" as a result of a little slack here and there in the kickover tool and the running tool.

If the kickover tool 30 is to be used in deviated wells, it is highly desirable that means be provided to prevent such sagging of the instrument. Such means may include the following means which will now be described.

The pivot arm, as shown in FIG. 8B, is provided with a cross bore 500 which is threaded as at 502 to receive a plug 504 as shown. The cross bore 500 is reduced as at 506, providing an upwardly facing shoulder 508. A plunger 510 having a flange or head 512 at its upper end is slidably disposed in bore 500 with its lower reduced diameter portion disposed in reduced bore 506. When the plunger 510 has its flange 512 engaged against upwardly facing shoulder 508, the reduced end of the plunger will protrude slightly from the pivot arm, as seen in FIG. 6B and 10B. A coil spring 520 is disposed in bore 500 and has its upper end supported against the inner end of screw 504 while its lower end bears against the head 512 of the plunger. Thus, the spring 520 constantly applies a force to plunger 510 tending to extend it as far as possible.

Plunger 510, as seen in FIG. 8B, is spaced inwardly of pivot pin 336 in the pivot arm. That is to say that the plunger is located between the pivot pin 336 and the pivot pin 332. When the pivot arm is in its kickover or misaligned position, seen in FIG. 8B, the exposed end of plunger 500 will apply a force to carrier 344 tending to rotate it about pivot pin 336 in a counter-clockwise direction. This force will cause the instrument 38 to swing outward away from the kickover tool until its lower portion is against the wall of the side pocket mandrel. The spring 520 should be sufficiently powerful to cause this action even if the side pocket mandrel should be in a horizontal position with the receptacle bore 36 on its upper side. The screw 504 may be used to adjust the loading or spring 520 as desired. The coil spring may be replaced by Belleville washers if extra strength is needed.

As was mentioned earlier, instrument 38 can be any suitable instrument for monitoring the desired parameter in the well. It is likely that such instrument will monitor both pressure and temperature, and since the pressure sensor will need to be temperature compensated, temperature data can be obtained with little added expense. Some such instruments are very accurate, very sophisticated, and very costly. They may represent a cost of tens of thousands of dollars. The running tool 346 is designed to install the delicate instrument in the side pocket mandrel gently to avoid damage thereto.

It may be desirable to provide means on the kickover tool for catching the instrument should it accidentally fall free of the running tool. Such means is shown in the drawing and will now be described.

Catcher means 550 is shown depending from actuator 320 in FIGS. 6B, 6C, 8B, and 10B. It includes rod means 552 and container means 554 attached to the lower end of actuator 320. Rod means 552 is shown to comprise a single rod but it could comprise two or possibly three rods of small iameter. The rod or rods should be sufficiently flexible to move freely through tubing which may not be perfectly straight.

Rod 552 has its upper end disposed in a downwardly opening hole 556 in actuator 320, as shown, where it is secured as by one or more pins such as pin 558. The lower end of rod 552 is received in the upwardly opening hole 560 of container 554 and is secured therein by suitable means such as weld 562 and/or weld 563.

Rod 552 is sufficiently long to place the open upper end of container 554 a spaced distance below the lower end of the longest instrument when the instrument is carried by the kickover tool. Thus the catcher means will not interfere with the normal operation of the kickover tool or with the process of installing the instrument in or removing it from the offset receptacle bore 36 of a side pocket mandrel.

The container 554 is provided with a bore 564 which is flared at its upper end as at 566 to guide the lower end portion of the instrument thereinto. The bore 564 is reduced in diameter as at 568 to provide an upwardly facing inclined annular no-go shoulder 570 for limiting telescoping movement of the instrument into bore 564. The diameter of bore 564 approximates that of receptacle bore 36 of the side pocket mandrel 30 and will thus support the instrument in an upright aligned position and when the kickover tool is lifted through the well tubing 24, the instrument will be lifted with it. Thus, the very costly instrument which otherwise may have been lost or, at least, severly damaged by dropping free in the well, may be retrieved from the well with ease and without making an extra trip into the well with a retrieving tool.

The instrument 38 may be retrieved from the side pocket mandrel by replacing the running tool with a suitable pulling tool. The running tool 346 can be converted to a pulling tool by pinning the flange 456 onto the cntrol rod 452 with a shearable pin and omitting the screws 426. This converted pulling tool is attached to carrier 335 and lowered into the well on the kickover tool 300. The kickover tool is then oriented and actuated in the manner explained hereinbefore. After actuation, the kickover tool is lowered. The lower end of the collet 420 enters the upper open end of the instrument and when the downwardly facing shoulder 436 on the collet fingers 430 engage upwardly facing shoulder 446 in the instrument, downward movement of the collet is arrested. Further lowering of the pulling tool causes the control rod 450 to be further lowered while compressing spring 464. The knob 470 on the lower end of control rod 450 will be moved to a lower position allowing the collet fingers to be cammed inwardly so that there bosses 432 can move downward past internal flange 444 of the instrument. Upon passing this internal flange, the collet fingers will spring back to their normal position, and at the same time, the spring 464 will expand and move the collet downward relative to the control rod to a position where the knob 470 thereon will support the collet fingers against inward movement to their releasing position. The pulling tool is now fully locked to the instrument and lefting the kickover tool will lift the instrument from its place in the side pocket mandrel. Of course, should the instrument be fouled in the receptacle bore 36, an upward pulling on the pulling tool of sufficient force will shear the pin holding flange 456 in position on control rod 450 and allow the flange 456 to move downward until it comes to rest upon knob 470. The collet now is supported solely by flange 456 which in turn is supported by knob 470. In this position, the collet fingers are positioned far below knob 470 and can be disengaged from the instrument readily by merely lifting the kickover tool with enough force to withdraw the unlocked collet from the instrument.

For the sake of convenience, the stop block 364, which could otherwise be provided in a simpler form, such as a pin, screw, shoulder, or wall, may be provided in the form shown in the drawing. As shown in FIGS. 6A, 8A, and 10A, stop block 364 may be slidably mounted on the actuator 320 by a pair of pins, such as pins 590 secured in suitable apertures in the stop block and having their projecting ends engaged in a pair of slots 592 each formed in an opposite wall of larger slot 358. Slot 592, as seen in FIGS. 8A and 10A, runs longitudinally of the actuator 320 and is straight except for a relatively small crook or convolution 594. The extreme upper end of the slot may preferably be in line with the straight portion thereof, as shown.

When it becomes desirable to relieve the load of spring 360, as when it is desired to work on the kickover tool without the detent being a hindrance, the stop block 364 is merely forced downward by placing the blade of a screwdriver in the small space 358 above the stop block and prying downward. As the stop block moves downward, its upper end must move inwardly a little for a short distance as the upper pin 590 follows the crooked portion of the slot. As the upper pin 590 passes this crooked portion of the slot, the stop block will move readily toward the lower end of the slot as the spring 360 unwinds to relieve its load.

To reload spring 360 and restore the detent to operating condition, stop block 364 must be lifted. To do this, the blade of a screwdriver is placed beneath it and the point of the screwdriver then engaged in the notch 596 formed in actuator 320 slightly below window 366, after which the screwdriver is used to pry and lift the stop block to its upper position seen in the drawing. As the stop block is lifted, the spring 360 will be wound or re-loaded and as the upper pin 590 of the stop block passes the crooked portion 594 in the slot, the block will snap into its operating position. The load of spring 360 will maintain the stop block in its upper position (shown), since the stop block can move downward only by overcoming the load of spring 360.

A modified form of kickover tool is illustrated in FIGS. 11A through 14 where it is indicated generally by the reference numeral 600. The kickover tool 600 is very similar to the kickover tool 300 previously described but which, because of certain improvements incorporated therein, may be preferred by some operators.

Kickover tool 600 is provided with a body 602 having a flat side 604 and with an actuator 606 having a flat side 606. The body and actuator are assembled with their flat surfaces 604 and 608 facing each other and are secured together for limited longitudinal sliding movement. As will be seen in FIG. 13, the actuator 606 is formed with a T-slot 610 in which a T-ridge 611 formed on the body is engaged, thus holding the flat surfaces 604 and 608 in close proximity. Upward movement of the actuator 606 relative to the body is limited by engagement of the upper end of the actuator with the downwardly facing shoulder 612 formed on the body at the upper terminus of flat surface 608. Downward movement of the actuator relative to the body is limited by the pivot arm 614 when it reaches its full kickover position as in the kickover tool 300, as before explained.

Figure 11A:
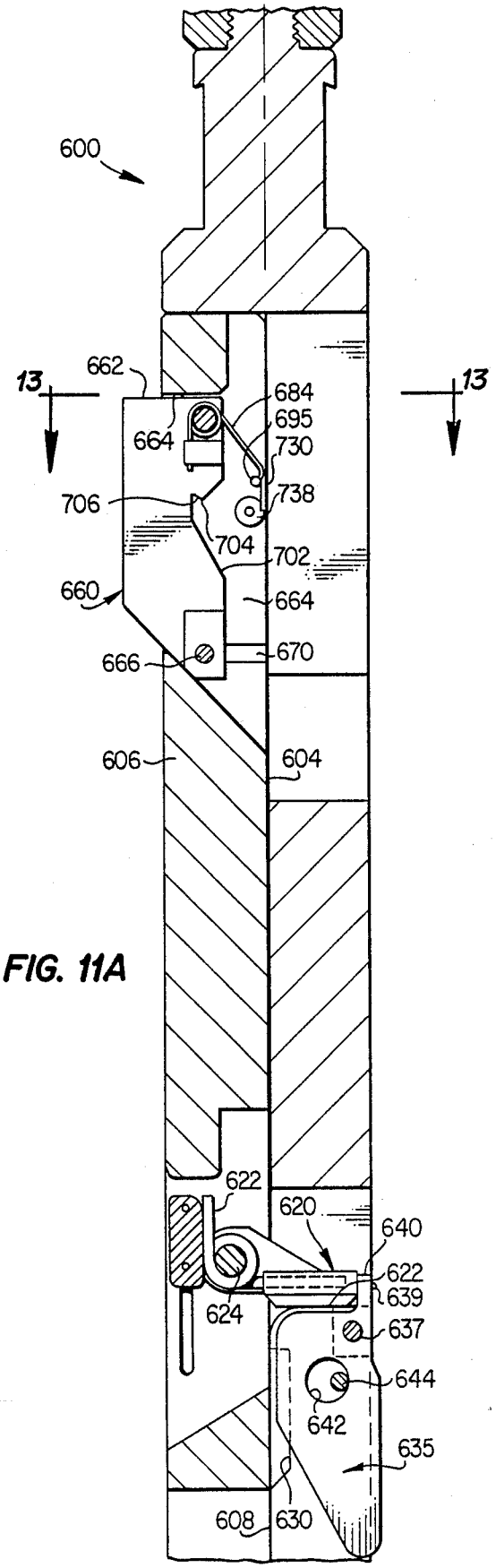
FIGS. 11A–11B together constitute a longitudinal sectional view showing a modified form of the kickover tool in the running mode and having a running tool attached thereto from which is supported an instrument.

The detent 620, as seen in FIG. 11A, being biased by spring 622 applies a force to the upwardly facing shoulder 622 of the body tending to move it downward while at the same time applying a force to its pivot pin 624 tending to lift the actuator in which it is installed. Thus the actuator is initially held in the running position upon the body as clearly shown in FIGS. 11A and 11B. As the actuator 606 is moved to its lower position as seen in FIGS. 12A and 12B, the detent 620 is rotated counter-clockwise against the bias of spring 622 and upon reaching its lowermost position, its upper edge 626 engages beneath the downwardly facing shoulder 628 provided by the recess 630 formed in the flat surface 608 of the body, as shown. Thus, the detent locks the actuator in its lowermost position and positively but releasably locks the pivot arm 614 in full kickover position.

The detent is releasable as will now be explained. In FIG. 11A, it will be seen that a release lever 635 is pivotally mounted to the body 602 by pivot pin 637. A spring 639, better seen in FIG. 12B, is wound about pivot pin 637 and engages finger 640 formed on the short end of release lever 635 tending to rotate it counter-clockwise to its extended position shown in FIG. 12B. However, as seen in FIG. 11A, the finger 640 engages the outer end of detent 620 and prevents pivoting of the release lever by the spring. Thus, the detent holds the release lever in its retracted position wile the kickover tool 600 remains in the running mode seen in FIGS. 11A and 11B.

When the kickover tool 600 is actuated to its kickover position, shown in FIGS. 12A and 12B, the outer end of detent 620 engages in body recess 630 and also forces the release lever 635 to its extended position and holds it there, as seen in FIG. 12B.

Should it be desired to positively limit the release lever 635 to movement between its retracted and extended positions, this may be accomplished by any suitable means. One suitable means for limiting movement of the release lever is to form it with a hole therein such as hole 642 and drilling a transverse hole in the body for installation of pin 644 which passes through hole 642 of the release lever, thus limiting movement of the release lever, as clearly shown in FIGS. 11A and 12B.

An orienting key 660 is mounted near the upper end of the actuator 606 and is movable between an extended position, shown in FIG. 11A, in which it protrudes well beyond the periphery of the kickover tool and presents an abrupt upwardly facing shoulder 662 provided by its upper end. This orienting key resembles the orienting key found on the kickover tool illustrated and described in aforementioned Patent No. 4,442,893, FIGS. 10 and 14, and serves the same function, that of coacting with the orienting sleeve in the side pocket mandrel to orient and to activate the kickover tool in the well-known manner.

The orienting key 660 is mounted in a window 664 in the actuator 606 and carries a pivot pin 666 disposed in the transverse hold 668, this pin having its opposite ends engaged in a groove such as groove 670 formed in the side wall of window 664. Mounted thus, the orienting key is free to pivot about the pivot pin while the pivot pin is free to slide in groove 670.

Figure 15:
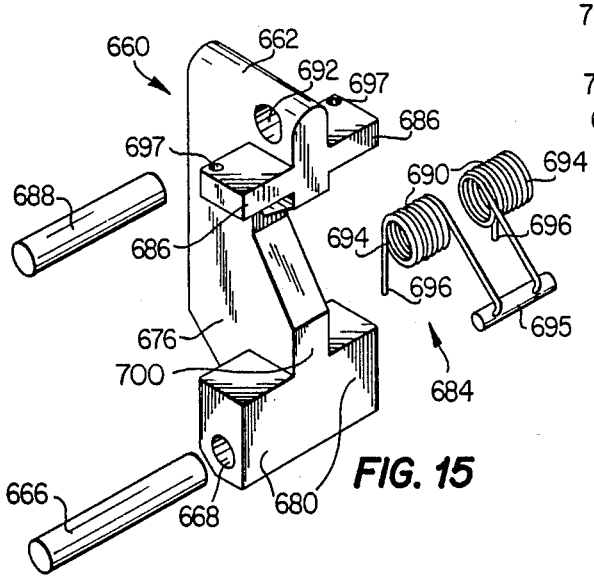
FIG. 15 is an oblique exploded view showing the orienting key together with its associated spring and pins.

The orienting key 660, as seen in FIG. 15, is formed with a relatively thin body 676 having a pair of oppositely extending wings 680 at its lower end through which the pivot pin 666 extends, and a pair of smaller wings 686 near its upper end for anchoring the spring assembly 684 which is mounted upon the orienting key by a spring mounting pin 688 which passes through the coiled portions 690 of the spring assembly and the transverse hold 692 formed about the wings 686 of the orienting key. The spring assembly comprises a mated pair of torsion springs 694 having one end of each secured as by suitable means such as brazing, welding, or the like, to a bar 695, each spring having a free end 696. In assembling the spring assembly 684 to the orienting key, the spring assembly is placed in position with its free ends 696 disposed in holes 697 formed in the wings 686 and with the coiled portions 694 of the springs aligned with the hole 692. The pin 688 is then inserted in the hole 692 and is centered so that each end thereof is disposed in one of the springs.

The inward side 700 of the orienting key may, if desired, be formed with a sizeable notch or recess 702 and having a small projection 704 providing a smaller notch or recess 706 which facilitate installing the orienting key in the actuator, as will now be explained.

Figure 16:
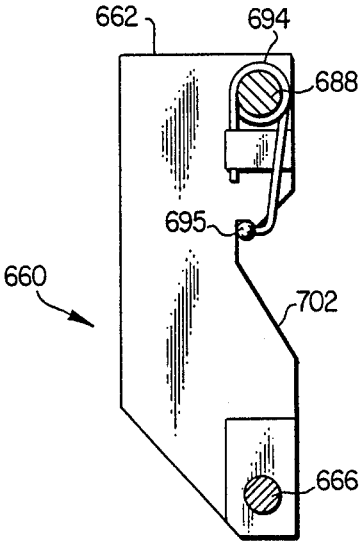
FIG. 16 is a side view of the orienting key showing the spring latched in operative position and ready for installation in the kickover tool.

After the spring assembly 684 has been assembled to the orienting key 660 and pin 688 has been inserted in hole 692, the bar 695 is depressed into large notch 702 and snapped over the small projection 704 and into the small notch 607. The bar will be retained in the small notch, as seen in FIG. 16, to thus hold the spring retained out of the way while the kickover tool is assembled.

Figure 11B:
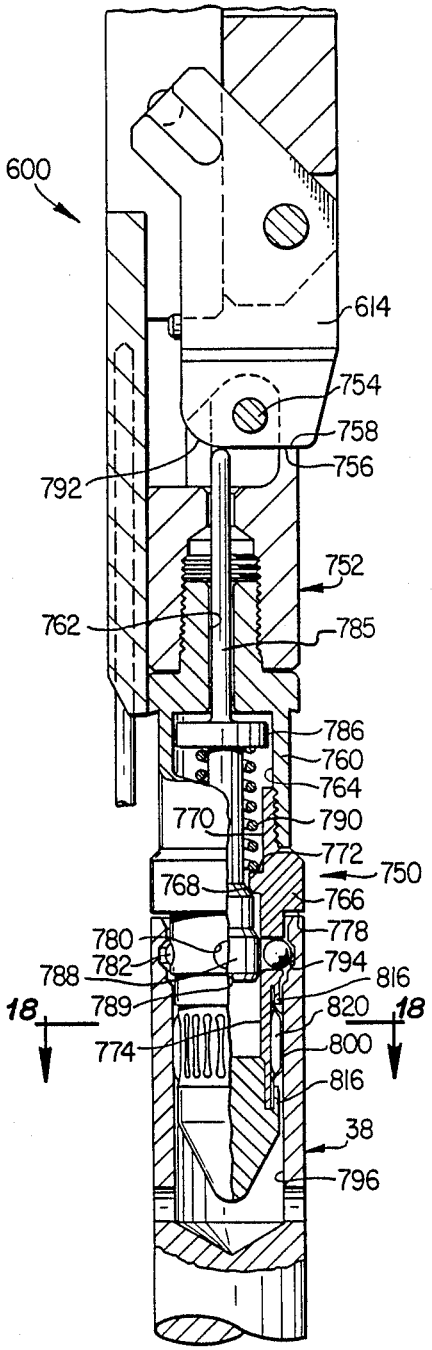
Figure 12A:
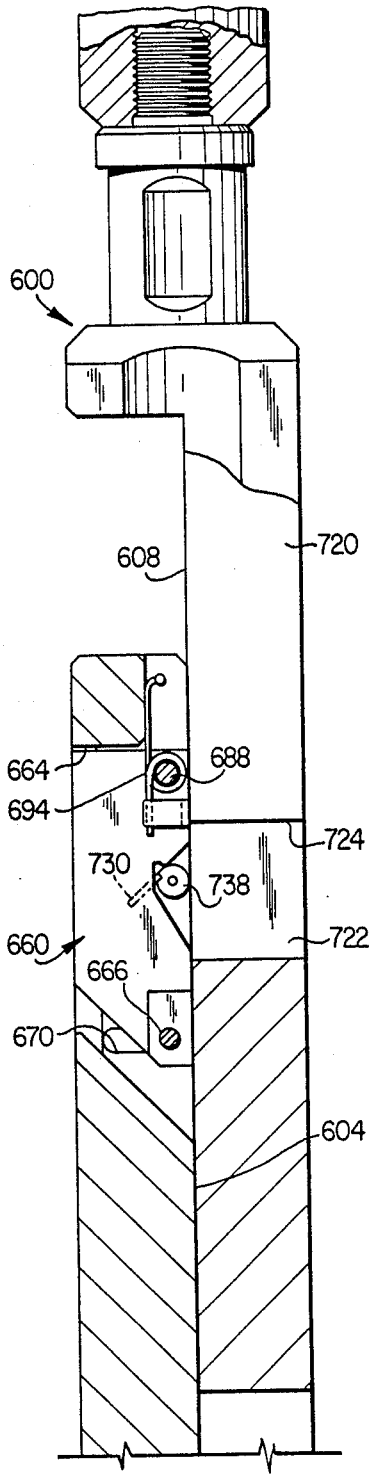
FIGS. 12A–12B together constitute a view similar to FIGS. 11A–11B but showing the kickover tool in kickover or misaligned position.
Figure 12B:
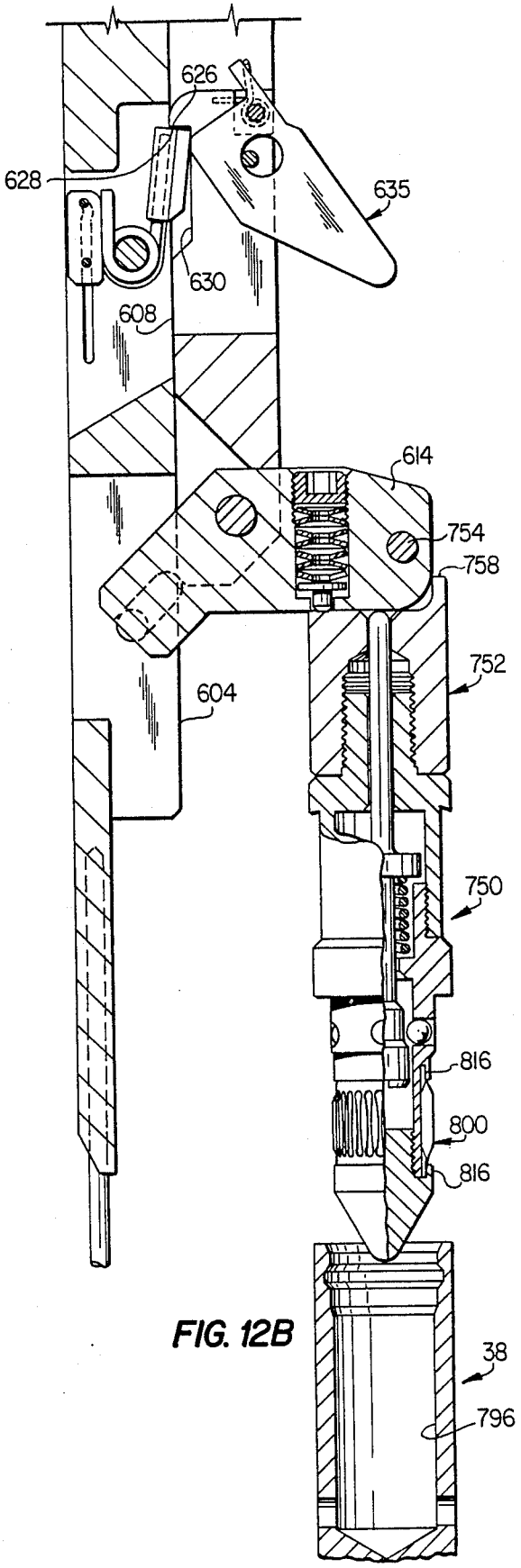
Figure 13:
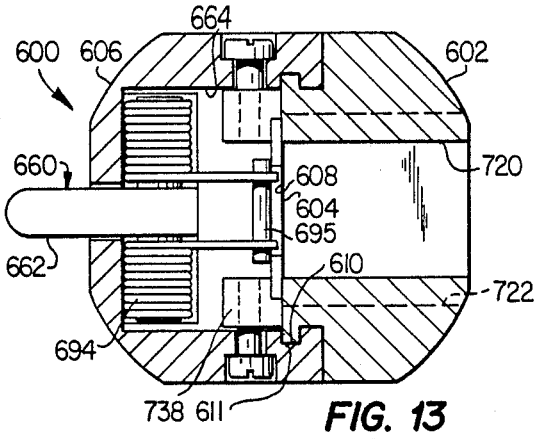
FIG. 13 is a cross-sectional view taken along line 13—13 of FIG. 11A.

When the kickover tool 600 is in the running mode as seen in FIGS. 11A and 11B, the orienting key 660 is in its extended position. The pivot pin 666 is at the outer end of groove 670 in the actuator. The spring assembly 684 has biased the upper end of the orienting key to its outermost position so that the upwardly facing shouler 662 provided by the upper end of the key is ready to engage the orienting sleeve in the side pocket mandrel upon upward movement of the kickover tool in the side pocket mandrel.

Figure 14:
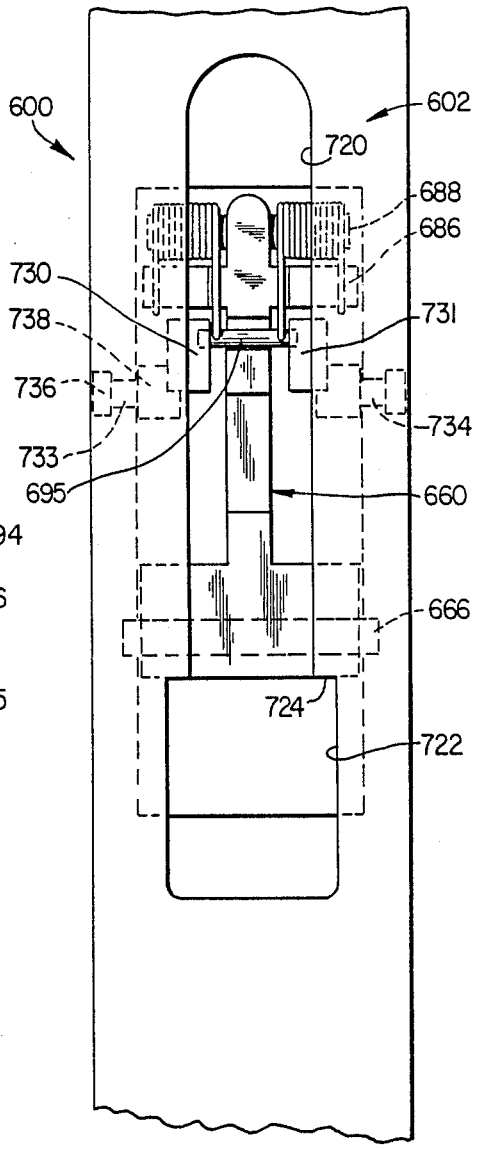
FIG. 14 is a fragmentary longitudinal view of an upper portion of the kickover tool of FIG. 11A looking from the side opposite that from which the orienting key protrudes.

Referring now to FIG. 14, it is seen that the kickover tool body 602 is provided with a longitudinal through slot 720 which is widened as at 722 providing a downwardly facing shoulder 724. In this view, the orienting key and related parts carried by the actuator 606 can be seen.

A pair of control plates 730 and 731 are mounted onto a pair of pivotably shafts 733 and 734. Each such shaft, if desired, may be made of a shoulder screw 736 and a nut 738, each such nut having a control plate such as control plate 730 secured thereto in a suitable manner such as by silver soldering, brazing, or welding. The plate 730 is fixed to the nut 738 as shown in FIG. 11B so that as the actuator moves downward relative to the body during actuation, the plates slide along the flat side 608 of the body. It is readily seen in FIG. 14 that the control plates 730 and 731 are spaced apart a distance less than the length of the bar 695 secured to the orienting key springs, that the control plates support the bar 695 so that the key springs are effective to apply a force to the orienting key to bias it outwardly toward extended position, and that the control plates cannot pivot to release the bar 695.

When the kickover tool is fitted in the side pocket mandrel and the orienting key engages the downwardly facing shoulder thereof, upward movement of the actuator is arrested but continued upward pull will lift the body further. As the body thus moves upward relative to the actuator, the control plates 730, 731 continue to remain effective in holding the bar 695 in place. But when the body gets very near its uppermost position relative to the actuator, the control plates move past the downwardly facing shoulder 724 provided by the widened portion 722 of slot 720. When the control plates become thus unsupported by the body and are free to pivot in a clockwise direction as seen in FIGS. 11A and 12B, the plates, with their shafts 731, will pivot and move out of the way of the bar 695. At this time, the torsion springs 694 unwind in a counter-clockwise direction and swing the bar until it comes to bear against the actuator, as seen in FIG. 12A. In this position, further unwinding of the springs 695 will cause the orienting key to be biased inwardly toward retracted position. Thus, the orienting key remains fully operative until the very last moment so that by the time the control plates clear shoulder 724 in slot 720 of the body, the detent shoulder 626 of detent 620 has begun to engage recess 630 of the body to positively lock the body in its upper position relative to the actuator.

A second form of running tool is provided for attaching a well tool, such as an instrument 38, or other well tool, to a kickover tool, such as a kickover tool 300 ot 600. This second form of running tool is shown in FIGS. 11B and 12B where it is shown attached to the kickover tool 600 and is indicated generally by the reference numeral 750.

The running tool 750 is connected to the pivot arm 614 of the kickover tool 600 through use of a tubular tool carrier 752 pivotally attached thereto by a pivot pin 754. The pivot arm is formed with an end face as at 756 which is engageable by the upwardly facing shoulder 758 to limit pivotal movement of the tool carrier relative to the pivot arm to the position shown in FIG. 11B. Thus, as the instrument is being lowered into a well on the kickover tool, the engagement of shoulder 758 of the tool carrier with the end face 726 of the pivot arm will maintain the instrument axially aligned with the kickover tool.

The pivot arm 614, similarly to the pivot arm 330, is provided with a cam surface and a spring-biased plunger as will be explained later.

The running tool 750 is similar to running tool 346 previously described with respect to FIGS. 6B and 8B. Running tool 750 is provided with a top sub 760 threaded to the tool carrier and having a bore 762 enlarged as at 764. Bore 764 is threaded at its lower end for attaching of tubular body 766 having a bore 768 whose upper end is enlarged as at 770 providing an upwardly facing shoulder 772 and whose lower end is enlarged as at 774. Tubular body 766 is formed with an external annular downwardly facing shoulder 778 and with at least one but preferably a plurality of windows such as window 780 formed in its wall in which a suitable lock member, such as ball 782, or an equivalent lock lug (not shown), is carried for radial movement between an outer locking position, as seen in FIG. 11B, and an inner released position, see in FIG. 12B

A control rod 785 is disposed inside the running tool and is formed with a flange 786 intermediate its ends and with its lower end enlarged as at 788. This enlargement is formed as a separate part and is screwed onto the control rod at assembly, as shown by the dotted lines, the enlargement or knob being held against rotation by a screwdriver engaged in the slot 789. A spring 790 surrounds the control rod and is supported on upwardly facing shoulder 772 in the body 766 while its upper end is engaged beneath the flange 786 of the control rod. Thus, the spring biases the control rod upwardly toward its upper position, seen in FIG. 11B, and maintains its upper end in contact with the cam surface 792 of the pivot arm 614.

When the kickover tool is in the running mode, seen in FIGS. 11A and 11B, the control rod 785 is in its upper position and the knob 788 of the control rod holds the lock balls 782 in their outer position in which they engage the internal recess 794 formed in the upwardly opening bore 796 of the instrument 38, as shown. Friction means, soon to be described, are provided on the running tool for frictionally engaging the instrument and supporting it after the lock balls have been released for inward movement to disengage the instrument.

When the kickover tool is activated to kickover position as seen in FIGS. 12A and 12B, the cam surface 792 on the pivot arm 614 forces the control rod to its lower position wherein the knob 788 thereon is disposed below the lock balls 782, thus releasing them for free inward movement to releasing position, so that the running tool 750 may be merely withdrawn from the bore 796 of the instrument by simply lifting the kickover tool after the instrument has been engaged fully in the receptacle bore of the side pocket mandrel.

When the kickover tool is withdrawn from the side pocket mandrel, the pivot arm and running tool are returned to their initial aligned position, see in FIGS. 11A and 11B.

Figure 17:
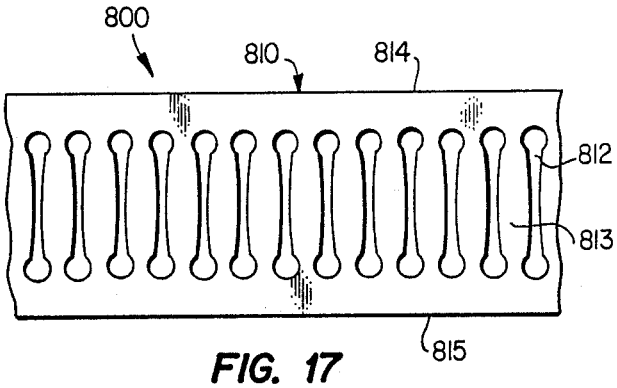
FIG. 17 is a fragmentary view showing the louvered friction member as it appears prior to being installed about the running tool of FIGS. 11B and 12B.

The friction means with which running tool 750 is provided is a suitable louver-type friction means such as louvered friction member 800 which is formed of a strip of suitable spring material. The strip is identified by the reference numeral 810 in FIG. 17 and is formed with a series of transverse slots 812 providing a series of bars 814 therebetween. These bars are then bent to a tilted position to form a series of louvers. The louvered strip 800 (which is similar in structure to the contact member 174 seen in FIG. 4) is then placed about the running tool where its upper and lower edges 814 and 815, respectively, are confined beneath opposed upper and lower lips 816 in order to retain the strip in place. The outer edges of the louvers project outwardly beyond the periphery of that reduced diameter lower portion of the running tool body below the windows 780.

Figure 18:
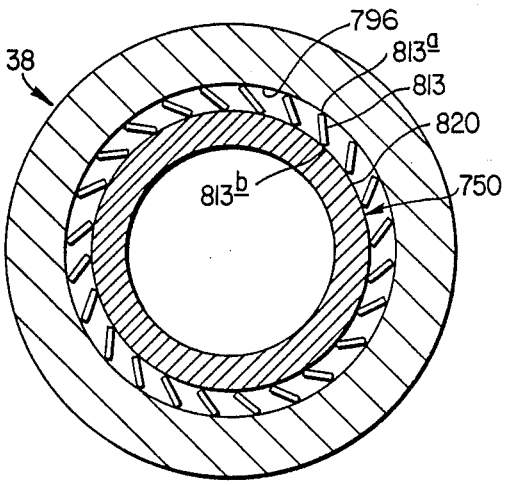
FIG. 18 is an enlarged cross-sectional view taken along line 18—18 of FIG. 11B, the louvers being shown schematically.

When the running tool is engaged in the upwardly opening bore 796 of the instrument 38, as seen in FIG. 11B, each louver 814 of the friction member 800 is flexed toward a flattened position since the inside diameter of bore 796 is somewhat smaller than the free span of the friction member when not confined in a bore. Thus the friction ring is an interference fit, and since each louver is a spring which is now flexed, such that it applies a force to the inner wall of bore 796 of the instrument and to the outer surface 820 of the running tool, considerable drag or friction is developed thereby. As seen in FIG. 18, each louver 813 has its outer edge **813*a* pressed against the inner wall of bore 796 of instrument 38 while the inner edge 813B of each louver is pressed against the outer surface 820 of the running tool. Because the friction member 800 is made of a rather heavy strip of spring metal and because of the multiplicity of louvers, the insertion and pullout force can be appreciable. For instance, if the weight of instrument 38** is in the range of about 9 to 15 pounds, or approximately 4 to 7 kilograms, the pullout force likely should be about 18 to 60 pounds (8 to 28 kilograms) or about 2 to 4 times the weight of the instrument in order to avoid dropping the instrument after the running tool is unlocked and before the instrument is inserted in the offset receptacle of the side pocket mandrel.

The louvered friction member should be formed of a high strength steel having both high corrosion resistance, a high modulus of elasticity, and low brittleness. A suitable material would be either MP-35-N Steel or Elgiloy Steel, although other materials may perform satisfactorily, especially under ideal conditions and in non-hostile environments. Brittle materials or materials which will become embrittled are to be avoided to prevent broken parts thereof falling in the well, especially falling into the offset receptacle where they would cause damage and malfunctions of the apparatus. (The friction member may, if desired, be paterned after the louver-type contact band provided in certain electrical connectors available from Hugin Industries, Inc., Los Altos, Calif.)

To install the instrument in the side pocket mandrel, the kickover tool 300 or 600 equipped with the running tool 750 is attached to a tool string and the instrument 38 is then engaged on the running tool. For this operation, the bore 796 of the instrument is telescoped over the lower end of the running tool and fully engaged while the operator rod 785 of the running tool is depressed (as by actuating the kickover tool to move the pivot arm to its kickover position). When the pivot arm is returned to return position, the operator rod will be lifted by the spring and the knob thereon will move to ball-locking position to positively lock the running tool to the instrument.

The instrument is lowered into the well carefully on the tool train until the orienting key of the kickover tool is located below the orienting sleeve of the side pocket mandrel. The tool train is lifted until the orienting key lodges against the downwardly facing trip shoulder of the orienting sleeve. This stops upward movement of the tool train after first orienting and then actuating the kickover tool. The pivot arm at this time holds the running tool and the instrument suspended therefrom in the channel 80 of the side pocket mandrel 30. The tool train is now lowered to insert the instrument into the offset receptacle 36 of the side pocket mandrel. The weight of the tool train, including the kickover tool and running tool plus the instrument, should be sufficient to move the instrument to its fully engaged position. The tool train is now lifted to smoothly disengage the running tool from the instrument. For this disconnect operation, the tool train must apply a lifting force of about 35 to 50 pounds minus the weight of the instrument. This upward force will not disengage the instrument from the side pocket receptacle.

Figure 19:
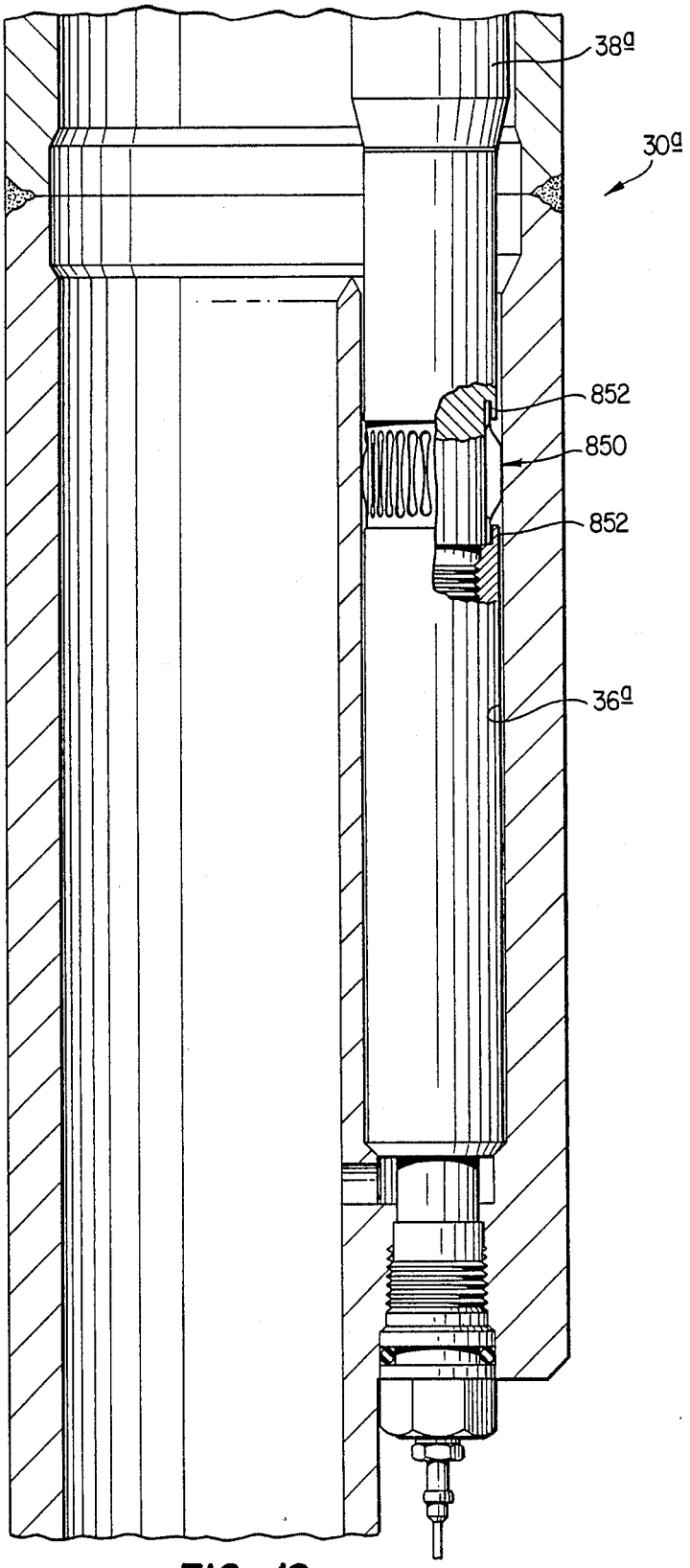
FIG. 19 is a fragmentary longitudinal sectional view of a modified form of side pocket mandrel showing an instrument frictionally held in the offset receptacle in which no locking recess has been provided.

The instrument may also be provided with a friction member of the type just described on the running tool 750 and indicated by the reference numeral 800. Such an instrument is seen in FIG. 19 where the instrument is seen to be indicated generally by the reference numeral 38*a*. This instrument is provided with a louver-type friction member 850 which surrounds the instrument, as shown, and has its upper and lower edges retained under the opposed upper and lower lips 852. The friction member 850 engages the inner wall of offset receptacle bore 36*a* of side pocket mandrel 30*a* and due to the spring action of each of the multiplicity of louvers retains the instrument in place by this frictional engagement. The axial force required to insert or withdrawn the friction member 850 should be about 50 to 75 pounds or about 22 to 34 kilograms. This pullout force generally exceeds the pullout force of the running tool by about 50 percent to assure that running will not lift the instrument from its fully engaged position in the side pocket mandrel. If the pullout force of the friction member 850 is too great in magnitude, it may be damaged upon being pulled from the receptacle during removal because of excessive energy being stored in the stretched wire line being suddenly released when the instrument pulls free.

The instrument 38*a* having the friction member 850 may be installed in the side pocket mandrel 30 which is provided with an offset receptacle bore having an annular lock recess 50 for engagement of the snap ring 46 of instrument 38.

If desired, a modified side pocket mandrel may be provided in which the lock recess is omitted to provide a side pocket receptacle without recess such as receptacle bore 36*a* of side pocket mandrel 30*a*, seen in FIG. 19. The principal advantage in omitting the lock recess from the receptacle bore is to reduce the cost of the side pocket mandrel.

The friction member, whether used to support a well tool, such as instrument 38, on a running tool, such as running tool 750, or for the purpose of retaining a well tool such as the instrument 38*a* in a receptacle, such as the offset receptacle 36 or 36*a* of side pocket mandrel 30 or 30*a*, respectively, provides the advantage of providing an insertion force and a pullout force which are substantially equal, and which are negligibly influenced by lubrication or lack of it, and which are very closely repeatable over many insertion and pullout cycles. For instance, if the insertion force is about 50 pounds (about 23 kilograms), the pullout force will be also about 50 pounds (about 23 kilograms). Whether the parts are dry or well lubricated makes little difference. The reason for this is believed to result from the edge contact of the louvers which under high unit load cut through any lubrication and make intimate contact with surrounding metal. Even after repeated insertions and removals, say one hundred or more, the insertion and pullout forces remain virtually unchanged.

In the case of friction member 850 used to retain the instrument 38*a* in the receptacle 36*a* of side pocket mandrel 30*a*, due to its resilience, is very effective to centralize the instrument in the receptacle, and, more importantly, to absorb shock and vibration, as well as providing excellent grounding contact between the instrument and the receptacle of the side pocket mandrel 30*a*, thus protecting the very expensive and somewhat fragile instrument from damage.

It may be desirable to run a well tool into a well and install it in a landing receptacle using a running tool which supports the well tool only by frictional engagement therewith said well tool to be likewise retained in said landing receptacle only by frictional engagement therwith. The well tool may thus be "soft set" without utilizing upward or downward jarring impacts such as are common practice. Such a well tool and running tool are illustrated in FIG. 20, which see.

Figure 20:
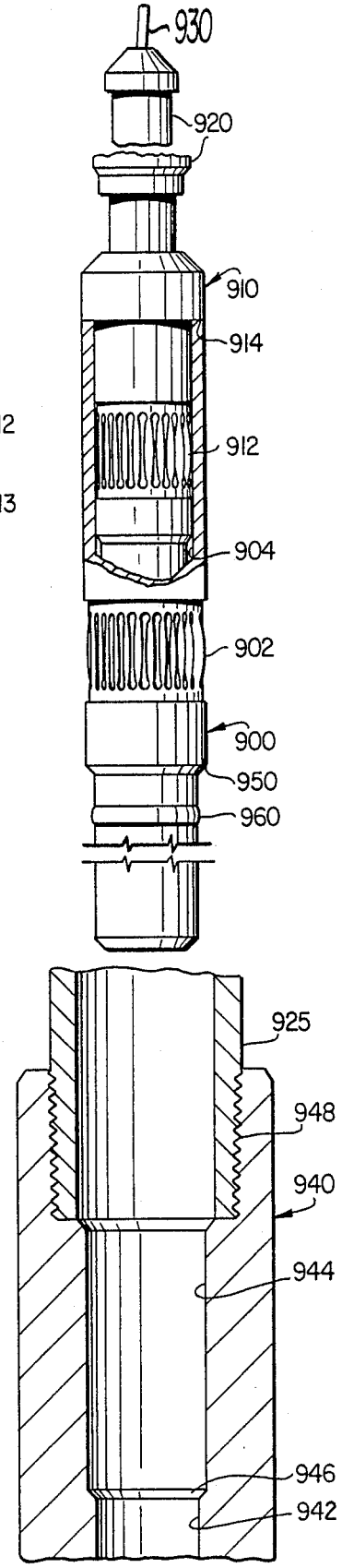
FIG. 20 is a view showing an instrument frictionally supported on a runnin-in tool string and about to be installed in a landing receptacle in a well flow conductor and frictionally retained there, the running-in tool string being subsequently pulled free and withdrawn from the well.

In FIG. 20, there is seen a well tool 900 having louvered friction means such as the louvered friction member 902 thereon and an upwardly opening bore 904 at its upper end in which is engaged a running tool 910 having a louvered friction member 912 thereon frictionally engaging bore 904 of well tool 900. Downwardly facing shoulder 914 on the running tool is engaged with the upper end of the well tool 900, as shown. The running tool 910 is a part of a tool string 920 lowerable into a well flow conductor 925 by suitable means such as the wire line 930, shown, or an electrical conductor line, or the like (not shown).

A landing receptacle 940 having a bore 942 which is enlarged as at 944, to provide upwardly facing stop shoulder 946, and threaded as at 948 is connected to or into the well flow conductor 925 to form a part thereof. The landing receptacle will receive the well tool 900. The downwardly facing shoulder 950 on the well tool will engage the upwardly facing stop shoulder 946 therein to limit downward movement of the well/tool. If desired, well tool 900 may be provided with a seal member, such as the seal member 960, for sealing with the bore 942 below the upwardly facing shoulder 946 in the receptacle 940.

The insertion and pullout force provided by louvered friction member 902 on well tool 900 may be, for instance, about 50 pounds (23 kilograms) and the entire tool string, including the running tool and the well tool will weigh in excess of 50 pounds (23 kilograms), sufficient to gently press the well tool into position into the landing receptacle 940 without jarring the well tool. Downward movement of the well tool in the receptacle will be stopped when downwardly facing shoulder 950 on the well tool engages the upwardly facing shoulder 946 in the receptacle.

The axial insertion and pullout force required to move the friction member 912 on the running tool 910 may be, for instance, about 30 pounds (13 to 14 kilograms) or about six-tenths of the insertion and pullout force provided by the friction member 902 on the well tool.

Thus, when the well tool 900 is lowered into the receptacle, the tool string 920 will force it gently to fully engaged position. Then when the tool string is lifted, the running tool will pull out leaving the instrument installed in the receptacle, the pullout force of the pulling tool being substantially less than the force required to overcome the pullout force of the instrument, which is actually the sum of the pullout force for its friction member (50 pounds) plus the weight of the well tool.

Actually, if the pullout forces were equal for both of the louvered friction members, the pulling tool should pull out, leaving the instrument in place in its receptacle since the weight of the instrument favors this result. However, it is recommended that a safety factor be provided.

Figure 21A:
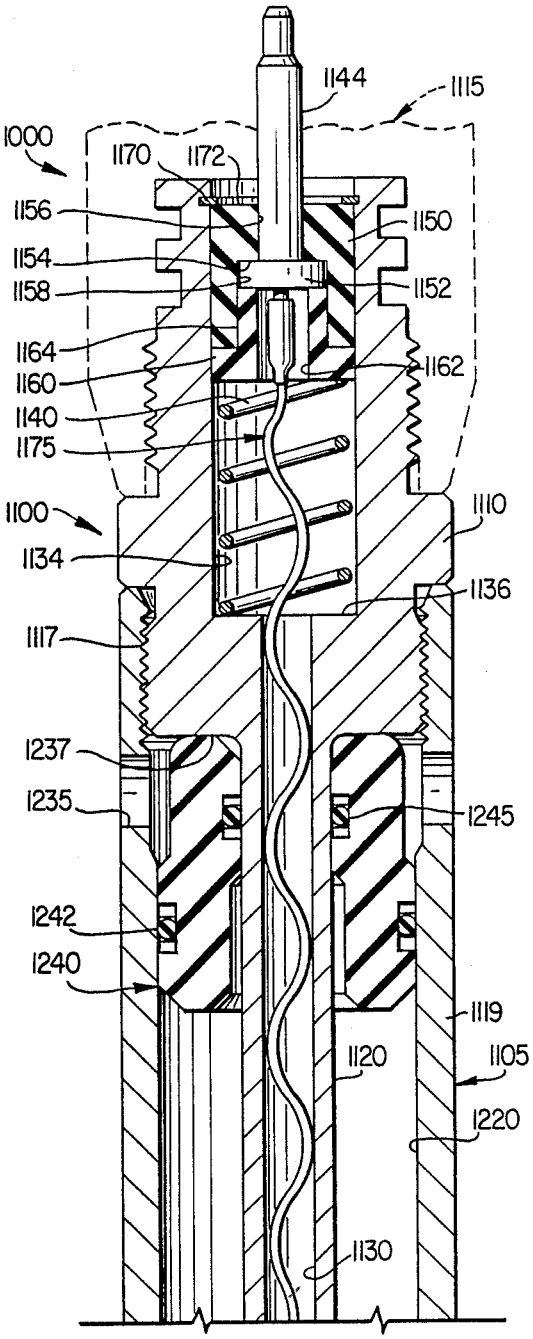
FIGS. 21A and 21B together constitute a fragmentary longitudinal sectional view of a modified instrument similar to the instrument of FIGS. 2B–2C.
Figure 21B:
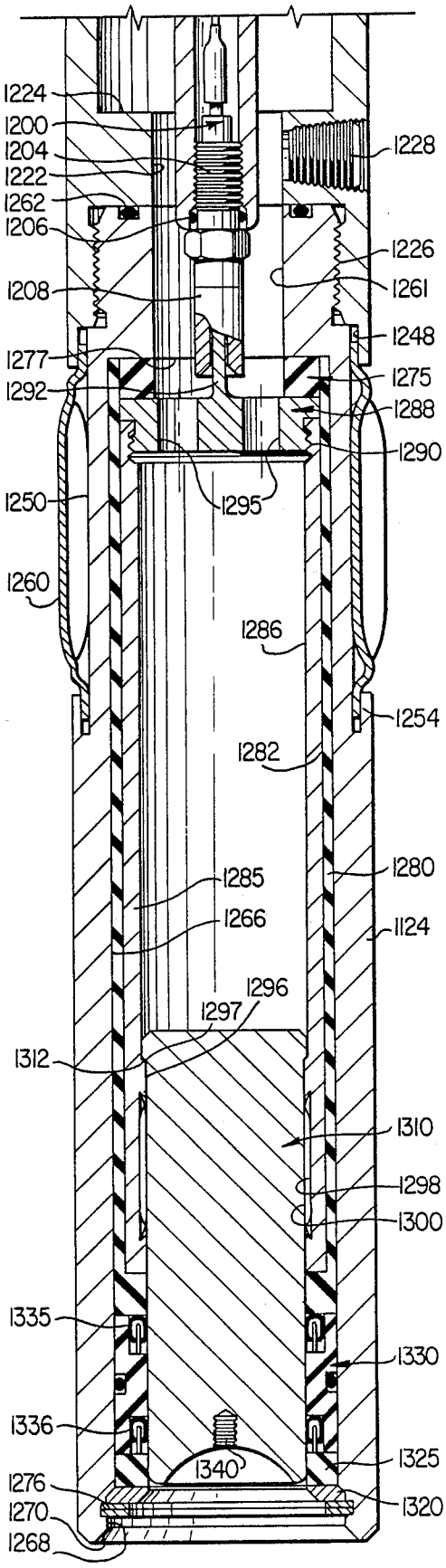

Referring now to FIGS. 21A–21B, it will be seen that a modified form of instrument is provided and is indicated by reference numeral 1000. This instrument differs from the instrument 38 previously described only in that the coupler 127 and the female connector member 125 have been replaced by the female connector member seen in FIGS. 21A–21B and indicated generally by the reference numeral 1100.

The female connector member 1100 is provided with a housing 1105 comprising a connector 1110 threadedly attached to the upper or sensor portion 1115 of instrument 1100. This connector member is threaded as at 1117 intermediate its ends for connection to cylinder 1119 as shown. The lower portion of the connector is reduced in outside diameter as at 1120 to provide a tubular extension which extends down to a location near or a little below the upper end of housing member 1124 which is threadedly attached as at 1128 to the lower end of the cylinder 1119.

The lower portion 1120 of the connector has a bore 1130 which is enlarged as at 1134 provided an upwardly facing shoulder 1136 which supports coil spring 1140.

An electrical prong 1144 projects from the upper end of the female connector member 1100 and makes electrical contact with the sensor portion of the instrument. This prong 1144 is disposed in a first insulator member 1150 as shown and an external flange 1152 formed near its lower end abuts the downwardly facing shoulder 1154 formed as a result of bore 1156 of the first insulator member 1150 being enlarged as at 1158.

A second insulator member 1160 having a bore 1162 has its upper reduced diameter portion 1164 telescoped into bore 1158 of the first insulator 1150 and its upper end is pressed against the lower side of flange 1152 of the prong 1144. The coil spring 1140 yieldingly supports the prong 1144 and its insulators 1150 and 1160 in their upper position with the upper end of the prong pressed into firm contact with its mating socket in the instrument. The snap ring 1170 limits upward movement of the prong 1144 when the female connector member is detached from the instrument, but when it is connected to the instrument, the upper end 1172 of the insulator should be spaced a short distance below the lower side of snap ring 1170.

An insulated electrical conductor wire 1175 is attached to the reduced lower end of prong 1144 by suitable means. This wire runs down through bore 1130 of the connector and is attached to the upper end of plug 1200 threaded to the lower end of the connector 1110 as at 1204. This connector is sealed by seal ring 1206. The plug terminates at its lower end with an electrical socket 1208 whose purpose will be brought to light later.

Plug 1200 may be of any suitable type. A suitable type is a glass-ceramic feed through plug available from Kyle Technology of Rosenburg, Oreg.

The cylinder 1119 is provided with a smooth bore 1220 which is reduced as at 1222 providing an upwardly facing shoulder 1224. Bore 1222 is enlarged and threaded at its lower end as at 1226 for attachment of housing member 1124.

A lateral aperture intersects reduced bore 1222 of the cylinder 1119 and is threaded to receive pipe plug 1228. This provides a suitable port for filling the female connector member with a liquid dielectric in a manner to be later described.

The cylinder 1119 is provided with one or more lateral ports such as port 1235 which is spaced immediately below the downwardly facing shoulder 1237 at the upper end of reduced portion 1120 of connector 1110, as shown.

An annular floating piston 1240 is disposed in smooth bore 1220 of the cylinder 1119 and carries a suitable outer seal ring 1242 for sealing with the wall of bore 1220 and a suitable inner seal 1245 for sealing with the outer surface of reduced portion 1120 of the connector 1110. The floating piston 1240 is slidable in smooth bore 1220 between its upper position (shown), limited by its contact with downwardly facing shoulder 1237, and a lower position (not shown) limited by its contact with upwardly facing shoulder 1224.

Annular floating piston 1240 is preferably formed of a non-marring material such as, for instance, glass-filled Teflon, or the like, to avoid scoring the smooth inner wall 1220 of cylinder 1119.

Lateral ports 1235 admit well fluids from exterior of the instrument 1000 into cylinder bore 1220 where they act against the upper side of annular floating piston 1240 and apply a downward force thereto. The purpose of the floating piston will be later explained.

The extreme lower end of cylinder 1119 is formed with a counter bore as at 1248 to provide a downwardly extending or overhanging lip the function which will be explained later.

The housing member 1124 is slightly reduced in diameter as at 1250 and is further reduced at its upper end and threaded as at 1226, as before stated, for attachedment to the lower end of the cylinder 1119. It is undercut at the lower end of reduced diameter portion 1250 to form an upwardly extending lip as at 1254. When attached to the cylinder as shown, a pair of opposed upper and lower lips 1248 and 1254 are provided and spaced apart as shown for retaining a louvered friction member 1260 which may be exactly like the louvered friction member 850 previously explained and shown in FIG. 19 for retaining instrument 38*a* in position in the receptacle bore of the side pocket mandrel. If desired, the reduced diameter portion 1250 could be extended downwardly so that two louvered friction members could be placed therearound and retained in place with the help of an annular ring, having one lip looking up and another lip looking down, placed between. Two rings would provide twice the amount of drag.

The housing member 1124 is formed with a central bore 1261 and its upper face is provided with a suitable annular groove to accommodate a seal ring 1262 for sealing the threaded connection 1226.

Bore 1260 of the housing member is enlarged as at 1266 and is further enlarged very near its lower end as at 1268 and a retaining ring groove is formed in this further enlarged bore 1268 and chamfered as at 1270 as shown to receive a suitable retaining ring such as that shown at 1276.

A ring of suitable insulating material, such as ring 1275 is placed in bore 1266 and against downwardly facing shoulder 1277. A sleeve of suitable insulating material, such as sleeve 1280 has its upper end surrounding insulating ring 1275 and extends downwardly a considerable distance as seen in FIG. 20B. Sleeve 1280 has its bore 1282 reduced at its lower end to provide an internal annular flange 1284.

A female conductor member 1285 having a bore 1286 is disposed within insulating sleeve 1280 and a spider 1288 is attached as by thread 1290 to the upper end of the female conductor member and has an integral small diameter upstanding prong 1292 extending upwardly from its center, and this prong is engaged in downwardly opening socket 1208 to electrically connect the female conductor member to the socket 1208 and, therefore, to prong 1144 through insulated wire 1175. Spider 1288 is provided with one or more apertures 1295 for freely communicating the bore 1286 of the female conductor member with the smooth bore 1220 below the floating piston 1240 as will soon be explained.

The sleeve 1280 insulates the female conductor member from the housing.

Bore 1286 of the female conductor member is reduced slightly as at 1296, providing an upwardly facing shoulder 1297, and an internal annular recess 1298 is formed with a lip at its upper and lower ends for retaining a louvered contact member 1300 therein as shown. This louvered contact member 1300 may be exactly like that used in instrument 38 and indicated by the reference numeral 162 in FIG. 4.

A floating plug 1310 having an enlarged head portion providing a downwardly facing shoulder 1312 is slidable in bore 1286 of the female conductor member 1285. This floating plug is shown in FIG. 21B in its initial lowermost position with its downwardly facing shoulder 1312 engaged with upwardly facing shoulder 1297 of the female conductor member.

The floating plug 1310 extends downwardly almost to the lower end of the housing member 1124 and closes the lower open end of the female conductor member 1285 as will now be explained.

Retainer ring 1270 supports metallic ring 1320, as shown, and ring 1320 supports insulating ring 1325 which, in turn, supports insulating ring 1330 whose upper end abuts the lower end of insulating sleeve 1280. Insulating ring 1330 is formed with an external annular groove in which is disposed a suitable seal ring such as seal ring 1332 for sealing with the inner wall of the housing member 1124. Further, insulating ring 1330 is formed with an internal annular recess at its upper and lower ends in which is disposed upper and lower one-way seals indicated by the reference numerals 1335 and 1336 which will permit fluid to flow therepast in a downward direction, but will not allow fluid to flow therepast in an upward direction.

The floating plug 1310 is formed with its lower end face concave to conform to the hemispherical upper end of the upstanding contact which it engages when the instrument 1000 is installed in the well. The floating plug is also formed with a female thread 1340, as shown, for attaching a handling tool thereto for pulling the floating plug to its lowermost position when needed.

When the female connector member 1100 is assembled as shown in FIGS. 21A–21B, it is ready to be filled with a suitable liquid dielectric such as, for example, silicone oil. For the filling operation, the pipe plug 1228 is removed and a hose from a suitable hand pump is attached in its place. The female connector member is placed in an inverted position and the liquid dielectric is pumped into the cylinder 1119. As the liquid dielectric enters the device, air is displaced which escapes past the one-way seals 1335 and 1336. As the device is thus filled, the floating piston and the floating plug will be forced to their extreme positions shown in FIGS. 20A–20B (if they have, by chance, been moved therefrom). As the device becomes filled with the liquid dieletric, such liquid will being to escape past the one-way seals. Pumping is continued until air bubbles no longer escape past the one-way seals. The instrument is then placed in a horizontal position with the filler hole looking up. The pump hose is disconnected and the pipe plug is reinstalled and tightened to seal the filler port.

The female connector member 1100 may be filled either before or after connecting it to the instrument.

When the instrument is installed in the well and the female connector member is forced into the receptacle bore of the side pocket mandrel, it is telescoped over the upstanding contact therein which arrests and supports the floating plug. As the instrument continues its downward moement, liquid dielectric is displaced and escapes past the one-way seals, in the manner explained previously.

The floating piston 1240 separates the liquid dielectric below it from the well fluids above it. Should the volume of the liquid dielectric become reduced, as due to a decrease in temperature, the well pressure acting on the upper surface of the floating piston will force it downwardly to maintain well pressure on the liquid dielectric. Should the liquid dielectric expand, as due to an increase in temperature, the floating piston will be lifted to allow such expansion. Well temperature often changes as a result of changes in withdrawal rates, injection rates, or changes in fluids being produced or injected.

It is readily seen that a novel method of installing a well tool in a well flow conductor is now practicable, which method will now be described.

This method of installing a well tool in a well flow conductor having a landing receptacle therein comprises the steps of providing a well tool having an upwardly opening bore at its upper end and having first friction means thereon below said upper end, and a tool string including a running tool having second friction means thereon; frictionally engaging said second friction means of said running tool with said upwardly opening bore of said well tool; lowering said tool string with said well tool supported thereby into said well flow conductor until said first friction means on well tool frictionally engages in said landing receptacle and said well tool is at its lowermost position therein; lifting said tool string to disengage said second friction means of said running tool from its frictional engagement in said upwardly opening bore of said well tool; and withdrawing said tool string from said well.

Thus, it has been shown that the apparatus, side pocket mandrels 30 and 30*a*, electrical connector 44 and 140, the kickover tools 300 and 600, and the running tools 346, 750, and 910 fulfill the objects of the invention which were set out early in this application as do the friction members 800 and 912 on running tools 750 and 910 and those on instrument 30*a* and well tool 900.

The foregoing description and drawings of the invention are explanatory only and various changes in sizes, shapes, materials, and arrangements of parts, as well as certain details of construction, may be made within the scope of the appended claims without departing from the true spirit of the invention.

I claim:

1. The method of installing a well tool in a well flow conductor having a landing receptacle having an internal upwardly facing shoulder and forming a part thereof, said method comprising the steps of:

a. providing i. a well tool having walls forming an upwardly opening bore at its upper end and having first friction means mounted thereabout, said well tool also having an external downwardly facing shoulder, and ii. a tool string including a running tool having second friction means thereon;

b. frictionally engaging said second friction means of said running tool with the walls of said upwardly opening bore of said well tool;

c. lowering said well tool into said well flow conductor on said tool string until said well tool engages said landing receptacle, and allowing the weight of said tool string and said well tool to force said well tool into said landing receptacle until its external downwardly facing shoulder engages said internal upwardly facing shoulder in said landing receptacle;

d. lifting said tool string to disengage said second friction means of said running tool from its frictional engagement with the walls of said upwardly facing bore of said well tool and leaving said well tool with said first friction means thereon frictionally engaged in said landing receptacle; and e. withdrawing said tool string from said well flow conductor.

2. The method of claim 1, wherein said steps of providing said well tool with said first friction means and said running tool with second friction means, include:

a. providing said well tool with a body, an annular recess formed in its exterior surface, said recess having undercut walls forming upper and lower opposed overhanging lips facing each other, and forming a first friction member from a strip of springy metal by forming transverse slots therein leaving bars therebetween, permanently tilting said bars to resemble louvers, and placing said louvered strip in said recess about said body with the upper and lower edges thereof retained under said upper and lower lips; and b. providing said running tool with a body, an annular recess formed in its exterior surface, said recess having undercut walls forming upper and lower overhanging lips facing each other, and forming a second friction member from a strip of springy metal by forming transverse slots therein leaving bars therebetween, permanently tilting said bars to resemble louvers, and placing said louvered strip in said recess about said body with the upper and lower edges retained under said upper and lower lips.

3. The method of claim 1 or 2 wherein said first friction means on said well tool and said second friction means on said running tool each require an axial force of a predetermined value to cause them to disengage.

4. The method of claim 3 wherein the value of said predetermined axial force required by said first friction member exceeds that required by said second friction member by about 40 to 250 percent.

* * * * *